United States Patent [19]

Chida et al.

[11] Patent Number: 4,998,776

[45] Date of Patent: Mar. 12, 1991

[54] SHIELD TUNNELING WITH OPTIONAL SECTION AND MACHINE

[75] Inventors: Shohei Chida, Tokyo; Masami Kozaki; Toshinori Asahi, both of Osaka; Chiyoaki Ono; Seiji Iwasa, both of Tokyo; Taizou Fukunaga, Kobe; Moriyuki Takemura, Ashiya, all of Japan

[73] Assignees: Zaidan Hohjin Doboku Kenkyu Center; Nittoku Kensetsu Kabushiki Kaisha; Nippon Hyumukan Kabushiki Kaisha, all of Tokyo; Kabushiki Kaisha Kobe Seiko Sho, Kobe, all of Japan

[21] Appl. No.: 413,756

[22] Filed: Sep. 29, 1989

[30] Foreign Application Priority Data

| | | | |
|---|---|---|---|
| Feb. 15, 1989 | [JP] | Japan | 1-35613 |
| Apr. 18, 1989 | [JP] | Japan | 1-99869 |
| May 25, 1989 | [JP] | Japan | 1-133759 |
| May 25, 1989 | [JP] | Japan | 1-133760 |
| May 25, 1989 | [JP] | Japan | 1-133761 |
| May 25, 1989 | [JP] | Japan | 1-133762 |

[51] Int. Cl.[5] ..... E21D 9/10

[52] U.S. Cl. ..... 299/59; 299/61; 405/138

[58] Field of Search ..... 299/31, 33, 1, 55, 56, 299/57, 58, 59, 61, 90; 405/138, 141; 175/91, 319

[56] References Cited

U.S. PATENT DOCUMENTS

| | | | |
|---|---|---|---|
| 4,400,036 | 8/1983 | Bradley | 299/59 X |
| 4,844,656 | 7/1989 | Babendererde et al. | 299/56 X |

FOREIGN PATENT DOCUMENTS

| | | | |
|---|---|---|---|
| 2726445 | 12/1978 | Fed. Rep. of Germany . | |
| 2913129 | 10/1980 | Fed. Rep. of Germany . | |
| 3125082 | 1/1983 | Fed. Rep. of Germany | 405/138 |
| 3140203 | 4/1983 | Fed. Rep. of Germany | 405/138 |
| 3201587 | 7/1983 | Fed. Rep. of Germany | 405/138 |
| 102090 | 3/1982 | Japan . | |

*Primary Examiner*—Ramon S. Britts
*Assistant Examiner*—David J. Bagnell
*Attorney, Agent, or Firm*—Oblon, Spivak, McClelland, Maier, and Neustadt

[57] ABSTRACT

A shield tunneling method of excavating a tunnel with an optional cross section by rotating a center cutter about an axis extending in the direction of propulsion and revolving a planetary cutter around the axis so as to excavate the region between the profile of excavation by the center cutter and the desired profile of excavation. A machine for practicing the method includes a center cutter supported by the body of the machine so as to be rotatable about an axis extending in the direction of propulsion of the body, a rotary body rotatable about the same axis as the center cutter, a planetary cutter supported by the rotary body so as to be movable radially of the rotary body, and operating device for moving the planetary cutter in the radial direction to permit the planetary cutter to revolve along a locus during the rotation of the rotary body so that the planetary cutter excavates the above-mentioned region.

17 Claims, 38 Drawing Sheets

SHIELD TUNNELING WITH OPTIONAL SECTION AND MACHINE

BACKGROUND OF THE INVENTION AND RELATED ART STATEMENT

The present invention relates to shield tunneling machines for continuously excavating tunnels which are not limited to a circular shape in cross section but can be of an optional cross section Various shield tunneling machines have been proposed and placed into use for excavating tunnels. Generally, such tunneling machines have a cutter disposed on the front side of the machine body. The cutter is rotated about the central axis of the machine to excavate the ground in front of the machine toward which the machine is propelled, and the machine is advanced by an amount corresponding to the amount of excavation. Segment rings are then additionally provided for a further tunneling operation.

Unexamined Japanese Patent Publication SHO 59-102090 discloses a method of shield tunneling with an enlarged cross section so as to form a diametrically enlarged portion locally inside the excavated tunnel to provide a shelter or station.

Such conventional shield tunneling methods and machines are adapted to excavate tunnels by the rotation of the front cutter, so that the profile of excavation is limited to a circular shape only, and difficulties are encountered in excavating tunnels which are shaped otherwise in cross section. On the other hand, the tunnels for sewers, power lines and subways are generally required to have a cross sectional form other than circular in actuality. It has therefore been necessary to excavate the ground with a large circular cross section which includes such a differently shaped cross section. This necessitates an excessive excavating operation and attendant treatment for the resulting muck. The excessive work exerts a greater influence on the tunnel construction cost as the diameter of the tunnel increases as is the case with subways, consequently imposing a limitation on the application of the shield tunneling method.

According to the invention disclosed in the above-mentioned publication, a tunnel of usual diameter is first excavated, and segment rings are assembled. At the location where an enlarged portion is to be provided, the ground is thereafter excavated radially of the tunnel by a special operation, with the segment rings concerned removed. Thus, the disclosed method is not adapted to continuously excavate a tunnel having an optional cross sectional form other than the circular form.

SUMMARY OF THE INVENTION

The main object of the present invention is to solve the foregoing problem and to provide a shield tunneling machine for continuously excavating tunnels which are not limited to a circular form in cross section but can be of any form in cross section.

More specifically, the present invention provides a shield tunneling method of excavating a tunnel with an optional cross section by rotating a center cutter about an axis extending in the direction of propulsion and revolving a planetary cutter around the axis so as to excavate the region between the profile of excavation by the center cutter and the desired profile of excavation.

The present invention further provides a shield tunneling machine for excavating a tunnel with an optional cross section comprising a center cutter supported by the body of the machine so as to be rotatable about an axis extending in the direction of propulsion of the body, a rotary body supported so as to be rotatable about the same axis as the center cutter, a planetary cutter supported by the rotary body so as to be movable radially of the rotary body, and operating means for moving the planetary cutter radially of the rotary body to permit the planetary cutter to revolve along a locus during the rotation of the rotary body so that the planetary cutter excavates the region between the profile of excavation by the center cutter and the desired profile of excavation.

With the above construction, the ground face in front of the machine to be excavated is cut centrally thereof by the rotation of the center cutter, and the outer peripheral portion of the face is excavated with the planetary cutter which revolves around the center cutter along a specific locus, whereby a tunnel having a desired form in cross section in its entirely can be excavated as desired.

Preferably, the operating means for causing the planetary cutter to revolve along the desired locus comprises a pivotal member pivotally movably supported by the rotary body at a position away from the axis of rotation thereof and supporting the planetary cutter thereon at a position away from the axis of its pivotal movement, a guide member having a guide form in conformity with the desired profile of excavation, and regulating means for pressing the movable end of the pivotal member against the guide member for regulating the locus of revolution of the planetary cutter.

With this arrangement, the rotary shaft of the planetary cutter is pressed against the guide face of the guide member having a predetermined form to thereby regulate the locus of revolution of the planetary cutter. Accordingly, the planetary cutter is less likely to deviate from the locus even when subjected to an external force.

The planetary cutter can be effectively caused to follow the desired locus of revolution by another means which comprises pivotal member drive means for driving the pivotal member, and a drive control system for controlling the drive of the pivotal member so that the planetary cutter revolves along a locus in accordance with the desired profile of excavation.

With this arrangement, the profile of excavation by the planetary cutter can be easily altered merely by controlling the drive of the pivotal member differently.

On the other hand, the center cutter and the planetary cutter are rotatingly driven by means which comprises means for driving the rotary body, and a drive conversion mechanism for converting the rotation of the rotary body to the rotation of the cutters. Thus, it is desirable to rotate both the center cutter and the planetary cutter by the rotary body drive means. With this arrangement, both the center cutter and the planetary cutter can be driven by the same drive means. This is effective for rendering the machine simple in construction and less costly.

It is also useful to provide a planetary cutter drive means aside from the rotary body drive means, and a drive transmission for transmitting the drive force of the planetary cutter drive means to the rotary shaft of at least one planetary cutter. It is then possible to rotate the center cutter and the planetary cutter independently of each other with respect to the direction of rotation and the speed of rotation, and to set each cutter at a desired speed of rotation suited to excavation.

The above and other objects, features and advantages of the present invention will become more apparent from the following detailed description and the accompanying drawings.

DESCRIPTION OF THE PREFERRED EMBODIMENTS

Figure 1:
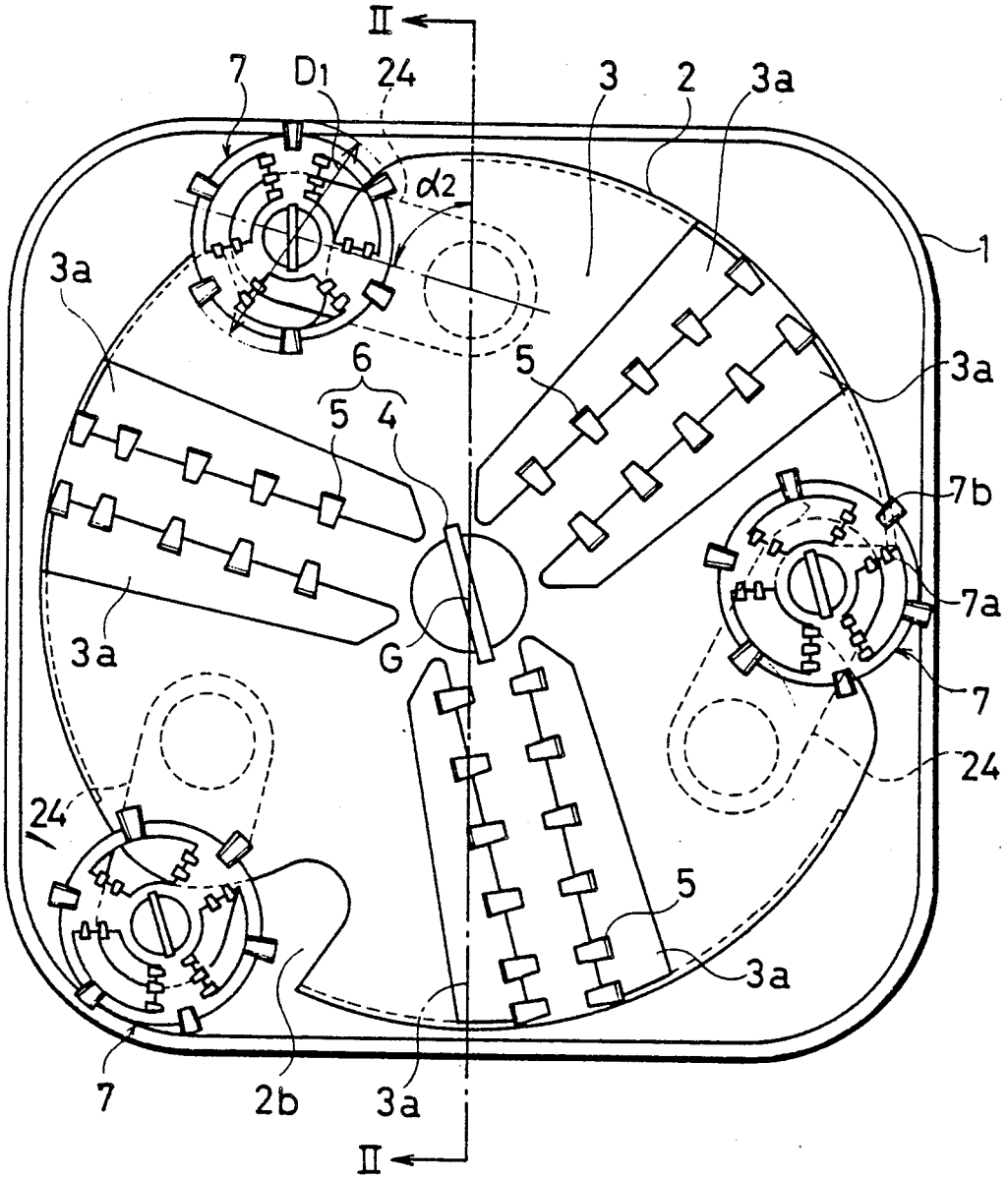
FIG. 1 is a front view showing a shield tunneling machine as a first embodiment of the invention.

A first embodiment of the invention will be described with reference to FIG. 1 to FIG. 5.

The illustrated shield tunneling machine has a skin plate (machine body) 1 in the form of a cylinder of square cross section. The skin plate 1 has housed in its front end portion a cutting wheel (rotary body) 2.

The cutting wheel 2 has a front plate 3 and a rear plate 10 and is rotatable about the central axis G (extending in the direction of propulsion of the machine) of the skin plate 1. The front plate 3 is formed with a plurality of radial slits 3*a* and has a center bit (center cutter) 4 centrally thereof. A multiplicity of cutter bits 5 are arranged at the edge portion of each slit 3*a*. The bits 4, and 5 provide a center cutter 6. A plurality of planetary cutters 7 having cutter bits 7*a* and 7*b* are arranged on front portions of the cutting wheel 2 along its periphery.

Figure 2:
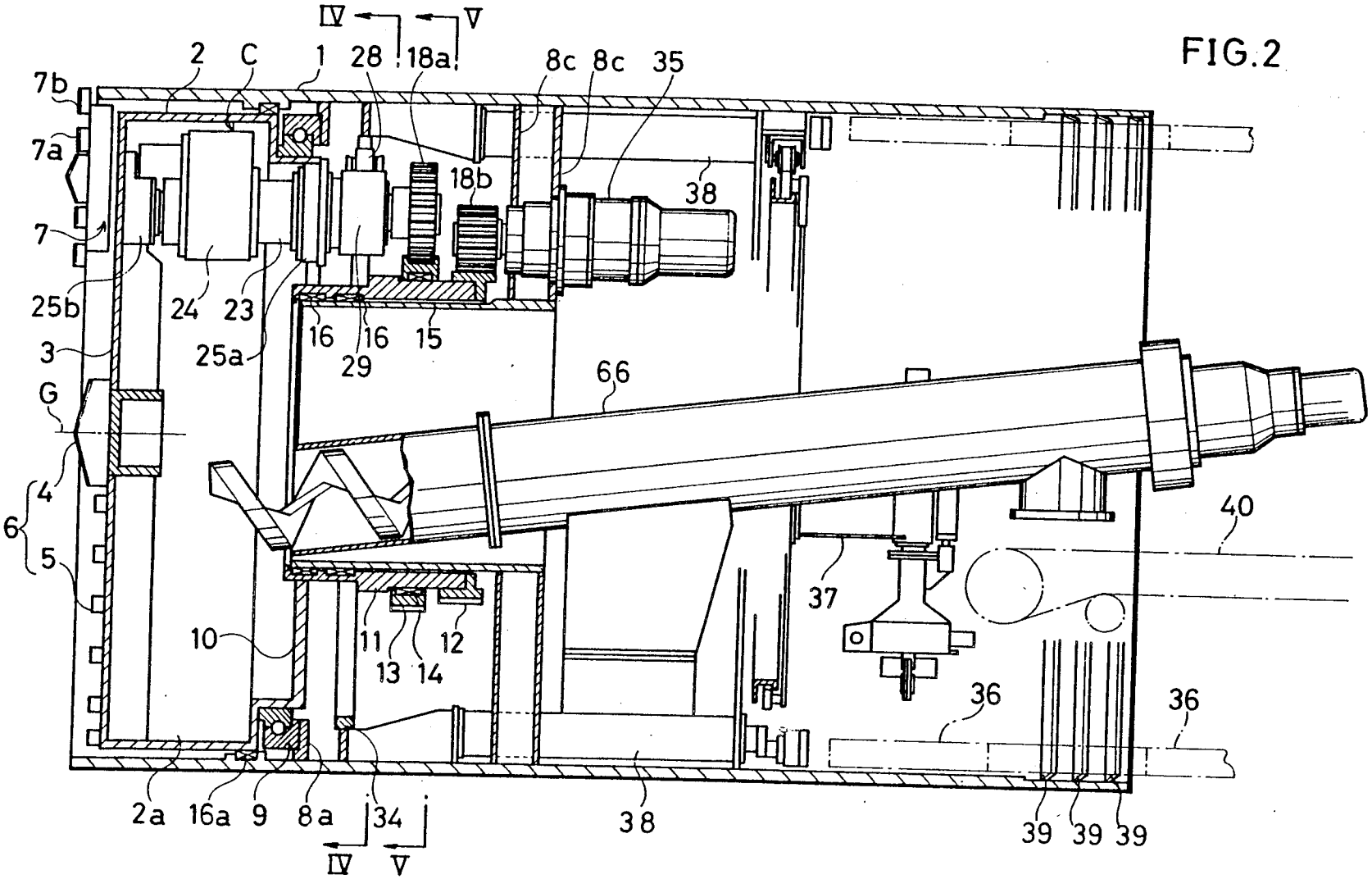
FIG. 2 is a view in section taken along the line II—II in FIG. 1.

As seen in FIG. 2, the outer periphery of rear portion of the cutting wheel 2 is joined to the inner ring of a swivel bearing 9 secured to a bracket 8*a* on the skin plate 1. A ring 11 extending rearward is secured to the rear plate 10 of the cutting wheel 2. A hollow fixed ring 15 is provided in the skin plate 1 centrally thereof. The ring 11 is rotatably fitted around the fixed ring 15 with seals 16 provided therebetween.

A cutting wheel drive gear 12 is secured to the rear end of the ring 11. A planetary cutter drive gear 13 is provided around the ring 11 with a bearing 14 interposed therebetween and is rotatably supported by the ring 11. To the rear of the ring 11, a motor (drive means) 35 having a reduction gear is fixedly mounted on brackets 8*c* on the skin plate 1. A pinion 18*b* mounted on the drive shaft of the motor 35 is in mesh with the gear 12.

Figure 5:
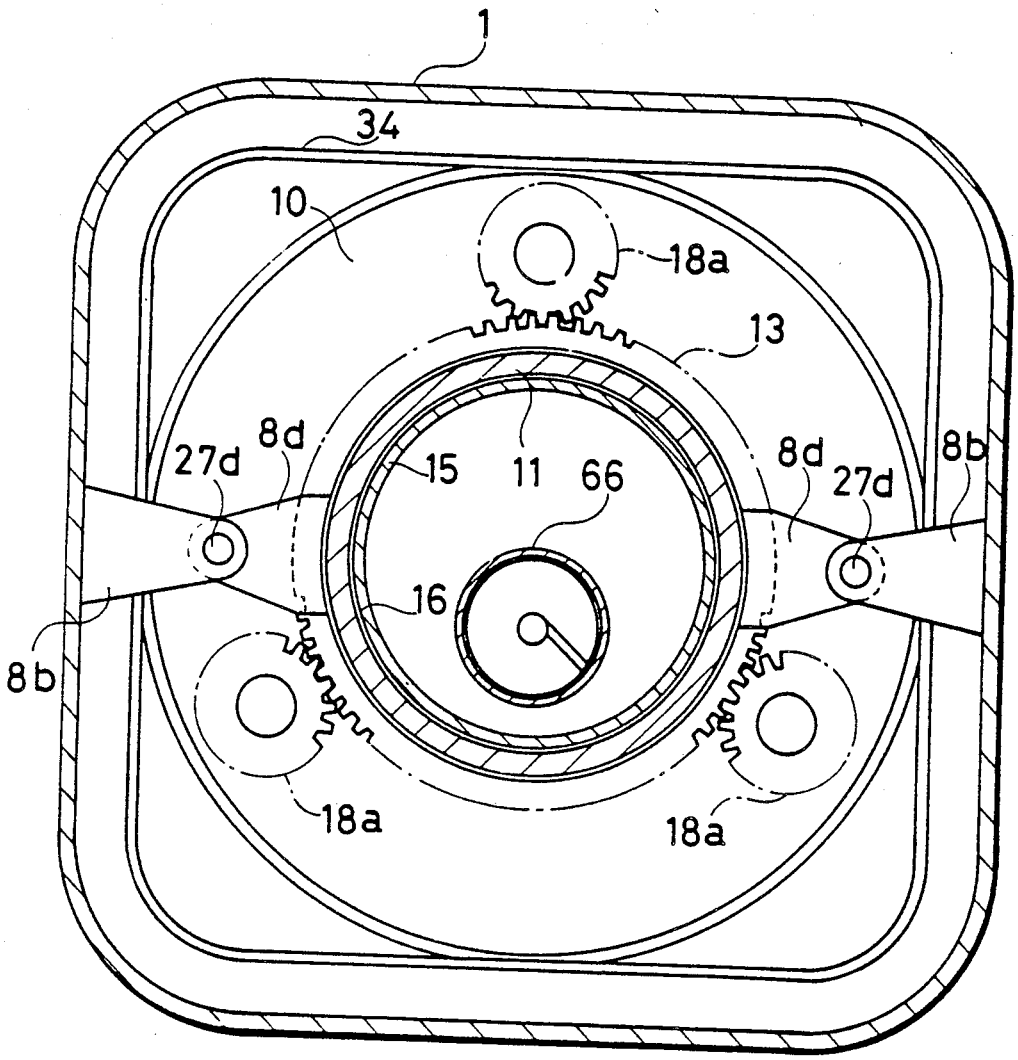
FIG. 5 is a view in section taken along the line V—V in FIG. 2.
Figure 6:
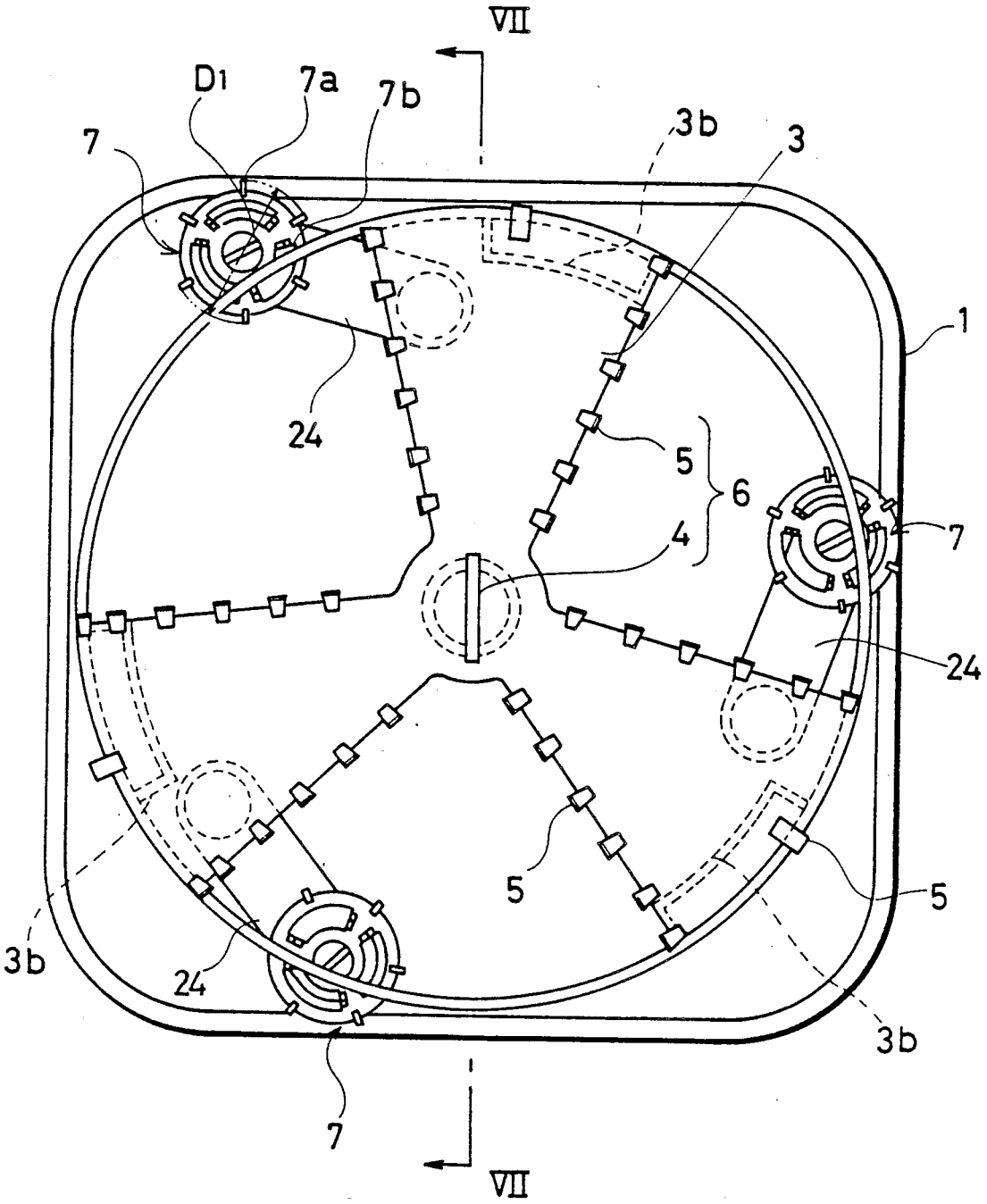
FIG. 6 is a front view of a shield tunneling machine as a second embodiment.
Figure 7:
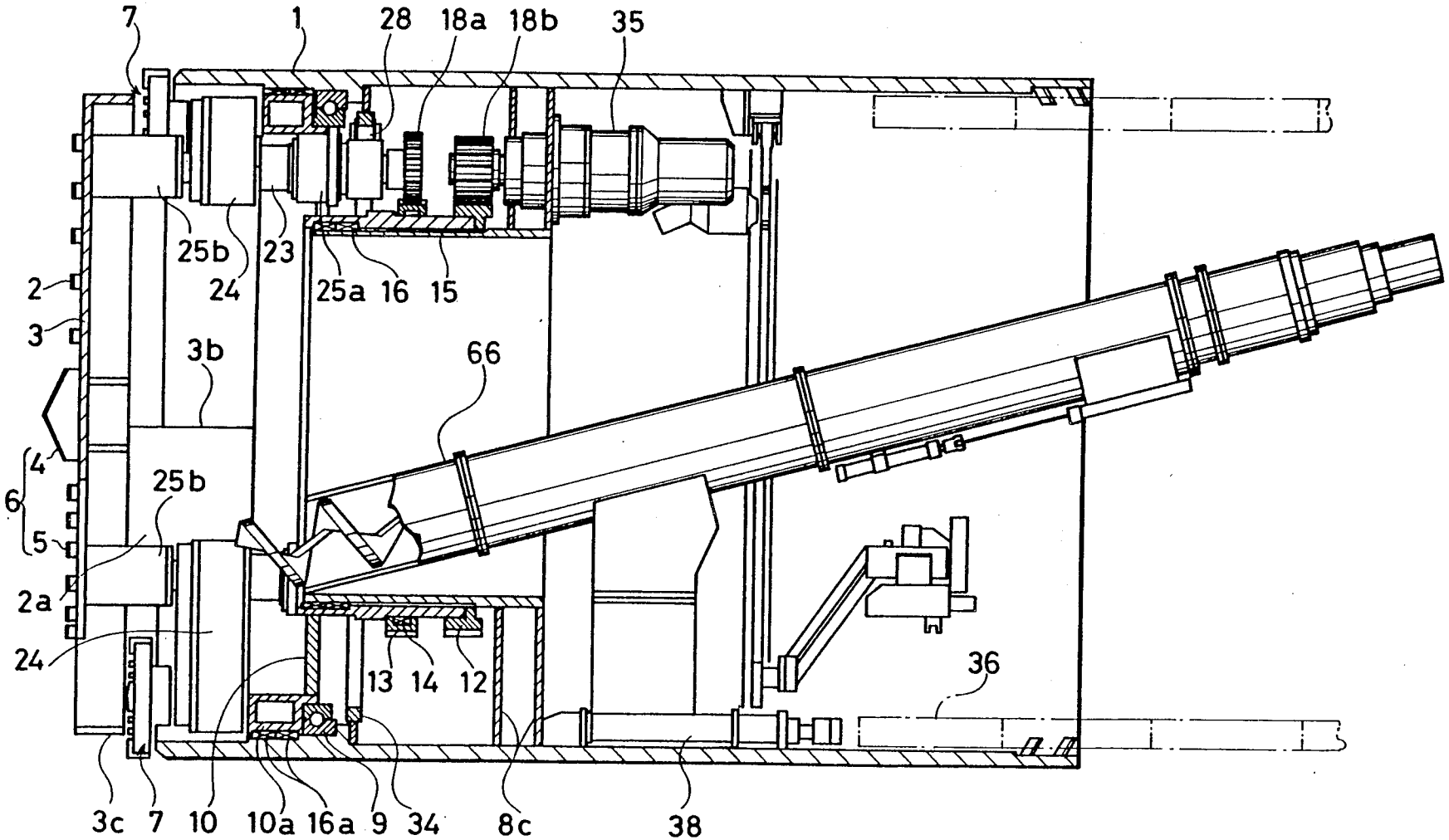
FIG. 7 is a view in section taken along the line VII—VII in FIG. 6.

As shown in FIG. 5, the planetary cutter drive gear 13 is provided at its opposite sides with brackets 8*d*, while the skin plate 1 is internally provided with brackets 8*b*. The brackets 8*b*, 8*d* are connected together by a pin 27*d*.

Indicated at 16*a* in FIG. 2 is a seal, which prevents earth or sand from ingressing into the rear portion of the machine along with the seals 16. The skin plate portion serving as a seat for the seal 16*a* has a circular inner periphery.

Next with reference to FIG. 3, a description will be given of the construction of a pivotal member for supporting the planetary cutter 7, and a drive mechanism C for driving the planetary cutter 7.

A torsion bar 23 extends through the rear plate 10 of the cutting wheel 2 longitudinally of the machine and is attached to the plate 10. A lever 24 and a control lever 29 are fixed respectively to the front and rear portions of the bar 23 to provide a pivotal member which is pivotally movable about the torsion bar 23.

More specifically, a housing 25*a* is fitted in a hole formed in the rear plate 10. The torsion bar 23 is rotatably supported by a bearing 26*a* provided inside the housing 25*a*. The bar 23 is generally in the form of a tube and has a drive shaft 19 rotatably extending therethrough longitudinally of the machine. The rear end of the shaft 19 projects outward beyond the bar 23. A planetary cutter drive pinion 18*a* is splined as at 20*a* to the projecting shaft end and is in mesh with the planetary cutter drive gear 13.

The lever 24 comprises a lever body 24*a* and a lever cover 24*b* separable therefrom. The lever cover 24*b* is formed with a shaftlike projection 24*c* in alignment with the drive shaft 19. A housing 25*b* accommodating a bearing 26*b* is secured to the rear side of the front plate 3. The projection 24*c* is rotatably supported by the bearing 26*b*.

Figure 3:
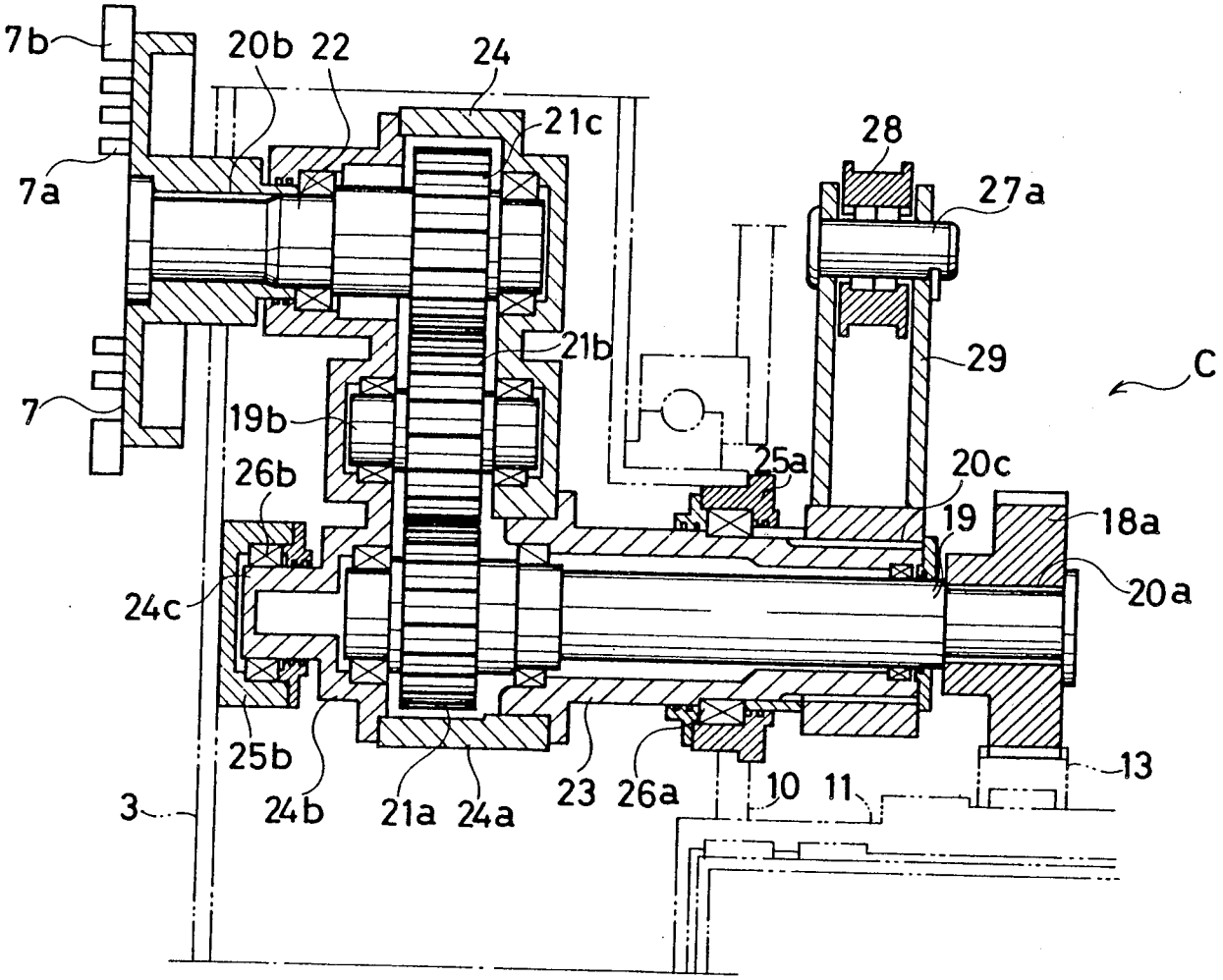
FIG. 3 is a sectional view showing a drive structure for planetary cutters in the machine.

The lever 24 has rotatably supported therein the rear end of a planetary cutter rotary shaft 22, an intermediate shaft 19*b* and the front end of the drive shaft 19 which are arranged downward in FIG. 3. These shafts 19, 19*b* and 22 fixedly carry gears 21*a*, 21*b* and 21*c*, respectively. The gear 21*a* is in mesh with the gear 21*b*, which in turn is in mesh with the gear 21*c*. The planetary cutter 7 is splined as at 20*b* to the front end of the rotary shaft 22. The cutting wheel 2 is formed with a cutout 2*b* (FIG. 1) in conformity with the locus of pivotal movement of each planetary cutter 7 to preclude interference therebetween.

When the pinion 18*a* rotates with the drive shaft 19 in the above arrangement, the rotation is transmitted to the rotary shaft 22 via the train of gears 21*a* to 21*c* to rotate the planetary cutter 7 about its own axis.

The control lever 29 is splined as at 20*c* to the rear end of the torsion bar 23 and has attached to its movable end a roller 28 which is rotatable about a pin 27*a*.

Figure 4:
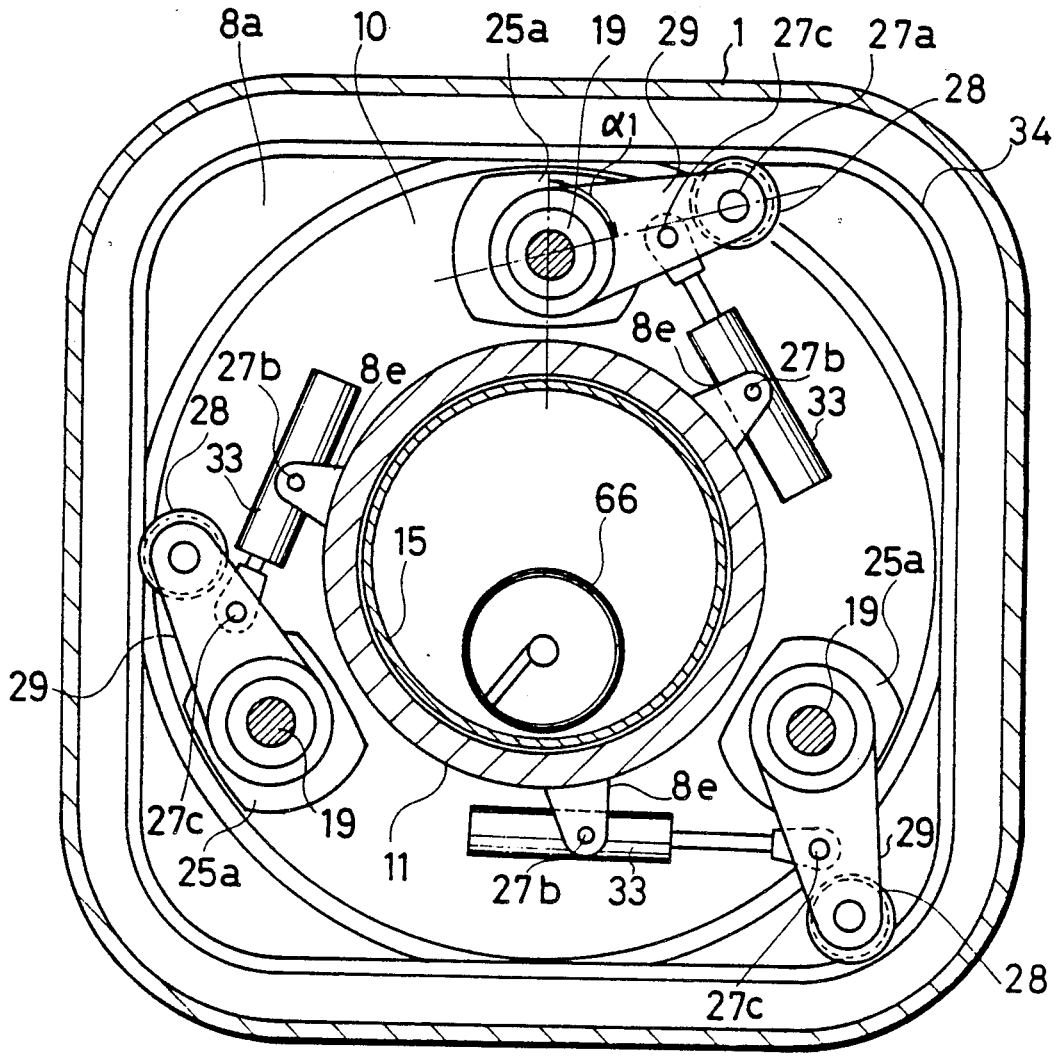
FIG. 4 is a view in section taken along the line IV—IV in FIG. 2.

With reference to FIG. 4, the ring 11 has a plurality of brackets 8*e* as arranged on its outer periphery. A stretchable member (regulating means) 33 is pivoted to each bracket 8*e* by a pin 27*b*. The control lever 29 is pivoted to the movable end of the stretchable member 33 by a pin 27*c*. The member 33 is connected as contracted to the lever 29, always exerting a force on the lever in the stretching direction.

The skin plate 1 is fixedly provided on its inner side with a guide rail (guide member) which is positioned in contact with the roller 28. The guide rail 34 has an inner periphery (guide face) in conformity with the desired profile (square in the present case) of excavation. The roller 28 is pressed against the inner periphery by the force of the stretchable member 33.

FIG. 2 further shows a screw conveyor 66 for transporting excavated earth rearward from the interior of a chamber 2*a*, an erector 37 for installing segments 36 on the wall of the tunnel excavated by the machine, a shield jack 38 for propelling the machine with a reaction delivered from the segments 36, and tail seals 39 for preventing earth, sand, water and the like from flowing into the machine from around the segments 36.

The operation of the shield tunneling machine will be described next.

The motor 35 within the skin plate 1, when driven, rotates the cutting wheel drive gear 12 meshing with the pinion 18*b* fixed to the motor drive shaft, further rotating the ring 11 and the wheel 2 connected to the gear 12.

With the rotation of the cutting wheel 2, each planetary cutter 7 and the entire drive mechanism therefor revolve together about the central axis G. Since the roller 28 on the outer end of the control lever 29 is pressed against the inner periphery of the guide rail 34 by the force of the stretchable member 33, the roller revolves along a locus in conformity with the form of the inner periphery of the guide rail 34. The control lever 29 is connected to the torsion bar 23 and the lever 24, so that the planetary cutter 7 supported by the outer end of the lever 24 also revolves along a locus in conformity with the form of the inner periphery of the guide rail 34 about the axis G, i.e., along a locus in conformity with the desired profile of excavation.

When the angle $\alpha 1$ (FIG. 4) at which the control lever 29 is attached to the drive shaft 19 is made equal to the angle $\alpha 2$ at which the lever 24 is attached to the shaft 19 (FIG. 1), the locus the cutter 7 follows becomes completely similar to the inner peripheral form of the guide rail 34.

On the other hand, the planetary cutter drive gear 13 is connected to the skin plate 1 by the brackets 8*b*, 8*d* as already stated and remains in a fixed position during the rotation of the cutting wheel 2, so that each planetary cutter drive pinion 18*a* meshing with the gear 13 rotates about its own axis while revolving around the gear 13. Through the mechanism described with reference to FIG. 3, the rotation of the pinion 18*a* is delivered to the planetary cutter rotary shaft 22, whereby the cutter 7 is driven at a specified speed of rotation.

Thus, while drivingly rotating the cutting wheel 2 and the planetary cutters 7 by the motor 35, the shield tunneling machine is advanced in its entirety by the force of the jack 38, whereby the central circular region of the ground is excavated with the center bit 4 and the cutter bits 5 which are in rotation centrally of the machine. At the same time, the region surrounding the circular region, i.e. the region between the central circular region and the desired profile of excavation, can be excavated with the cutter bits 7*a*, 7*b* of the planetary cutters 7 each rotating about its own axis and revolving along a specific locus around the central region. Consequently a tunnel can be excavated which has the desired form in entire cross section.

The earth thus excavated is led into the chamber 2*a* through the slits 3*a* formed in the front plate 3 and the cutouts 2*a* of the wheel 2, transported rearward continuously by the screw conveyor 66 and finally delivered onto the ground surface as by a belt conveyor 40 indicated in a broken line in FIG. 2.

In the above operation, the amount of earth to be withdrawn by the screw conveyor 66 may be so adjusted that the chamber 2*a* is filled with the earth and maintained at an internal pressure within a predetermined range. The earth within the chamber 2*a* and in front thereof will then smoothly flow into the opening at the front end of the screw conveyor 66 owing to a pressure difference resulting from the operation of the conveyor 66.

With use of the shield tunneling machine described, a tunnel having a desired cross sectional configuration can be continuously excavated easily by the center cutter 6 fixed to the cutting wheel 2 and the planetary cutters 7 supported by the wheel and arranged along the periphery thereof.

With the present machine, both the cutting wheel 2 and the planetary cutters 7 are driven by the motor 35 having a reduction gear and serving as a single drive source. Accordingly the above advantage can be realized with a simple construction of low cost. Since the locus of revolution of each planetary cutter 7 is defined by the guide rail 34 having a definite form, the cutter 7 is less likely to deviate from the locus even if subjected to an external force.

With the present embodiment, the hollow fixed ring 15 is disposed in the machine body centrally thereof, with the stretchable members 33 arranged on the outer periphery of the fixed ring 15. The interior space of the fixed ring 15 can therefore be utilized to install the screw conveyor 66 at a suitable angle of inclination.

A second embodiment of the invention will be described next with reference to FIGS. 6 to 10.

With this embodiment, the planetary cutters 7 in the first embodiment are arranged in the rear of center cutter.

The cutting wheel 2 is divided into a front plate 3 having radial blade-like portions, and a rear plate 10. The front plate 3 is provided with an outer peripheral ring 3*c* serving as a reinforcement, and the rear plate 10 with a ring 10*a* having a box-shaped cross section. The two rings 3*c* and 10*a* are interconnected by torque arms 3*b*. The housing 25*b* in the first embodiment extends forward, while the portion of the lever cover 24*b* for supporting the planetary cutter rotary shaft 22 has a reduced amount of projection.

Figure 9:
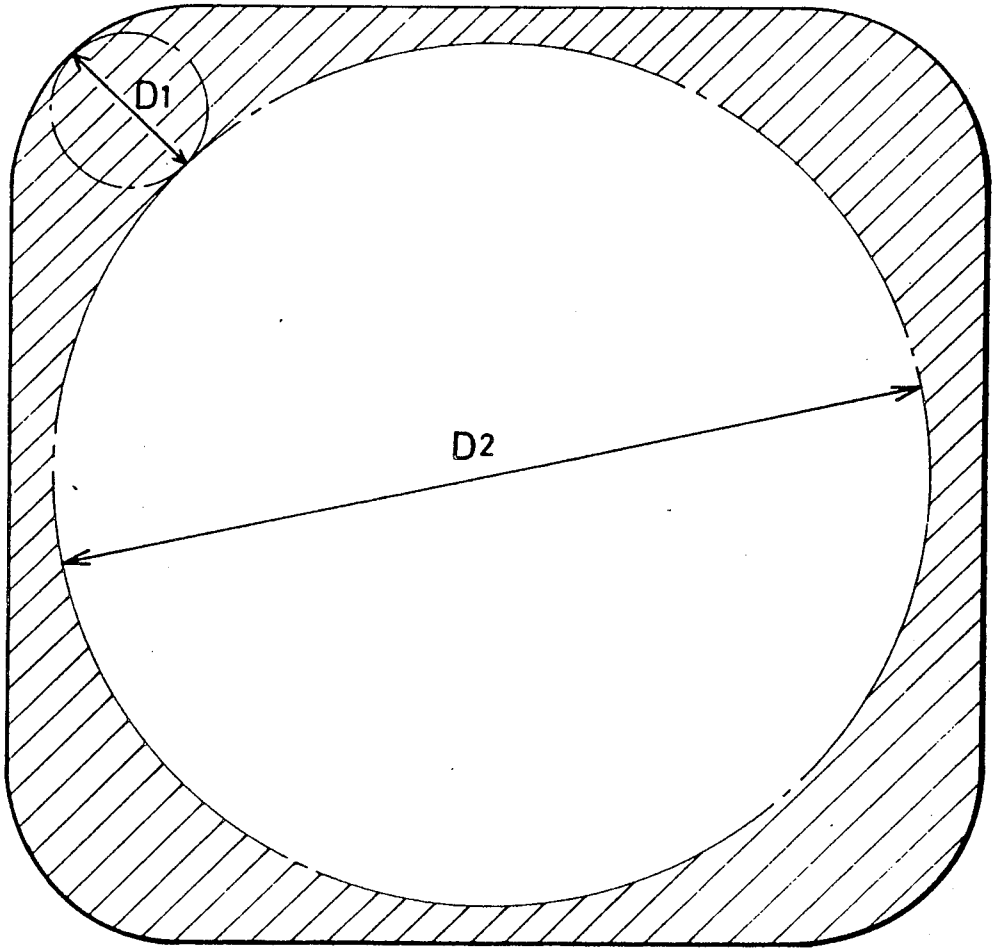
FIG. 9 is a diagram illustrating the region to be excavated by the planetary cutters of the machine as the second embodiment.

With the second embodiment, the center bit 4 and the cutter bits 5 provided on the front plate 3 first excavate the ground, and the ground portion around the excavated portion is then excavated with the planetary cutters 7 as indicated by hatching in FIG. 9.

Figure 10:
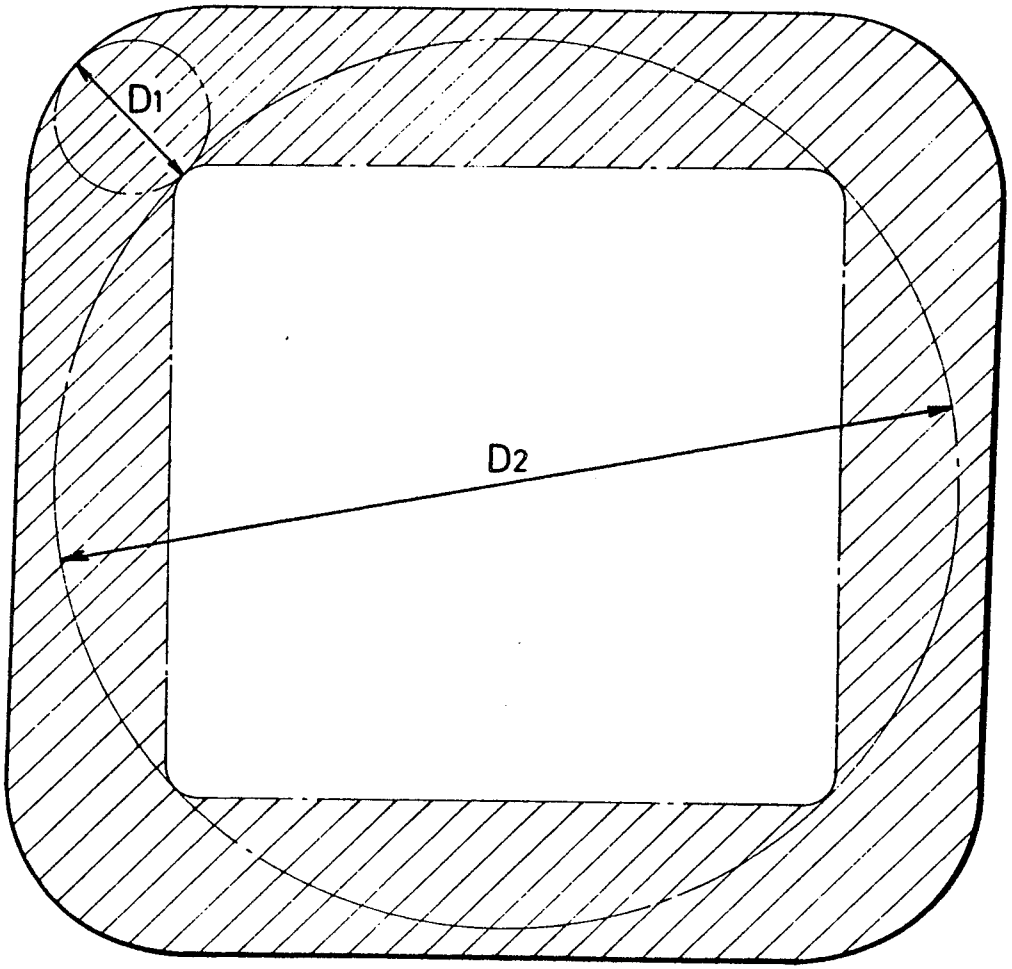
FIG. 10 is a diagram illustrating the region to be excavated by the planetary cutters of the machine as the first embodiment.

With the shield tunneling machine according to the first embodiment, on the other hand, the planetary cutters 7, which are disposed to the front of the front plate 3, first excavate the ground, and the remaining ground portion is then excavated with the center bit 4 and the cutter bits 5 on the front plate 3, with the result that the region excavated with the planetary cutters 7 is the hatached area shown in FIG. 10.

Thus, the region to be excavated by the planetary cutters 7 is much smaller with the second embodiment than with the first embodiment. This leads to the following advantages.

(1) Generally, the radius of gyration of the outer ends of the planetary cutter bits 7*b*, i.e., the radius D1 of outer periphery of the planetary cutter 7 is made smaller than the cutter diameter D2 of the cutting wheel 2. Accordingly, if the planetary cutter 7 is heavily burdened as is the case with the first embodiment (the ratio between the two cutters in work volume is about 1:1 in FIG. 10), the cutter bits 7*a*, 7*b* on the planetary cutter 7 wear earlier than the center cutter 6. However, if the planetary cutter 7 is disposed to the rear of the center cutter as in the present embodiment, the area to be excavated with the cutter 7 decreases, and the excavation by the center cutter 6 loosens the earth to lessen the burden on the cutter 7, with the result that the two cutters wear to similar extent. This lengthens the life of the tunneling machine in its entirety.

(2) Unlike the cutting wheel 2, the planetary cutter 7 requires a complex drive mechanism, so that the diminished burden on the planetary cutter 7 makes it possible to simplify the drive mechanism to reduce the manufacturing cost and compact the tunneling machine. Especially when the lever 24 inside the chamber 2*a* is given a reduced wall thickness, the earth will flow through the chamber more smoothly, while the earth removed by the planetary cutter 7 can be led into the chamber 2*a* with greater ease.

(3) The planetary cutter 7 is positioned inwardly of the skin plate 1 from the center cutter, so that if the planetary cutter 7 develops a trouble, for example, due to a break in cutter bits 7*a* or 7*b*, the trouble can be remedied easily.

A third embodiment will be described next with reference to FIG. 11.

With the shield tunneling machine described, it is practice to inject muddy water from inside the machine into the chamber 2*a* and apply the water to the cutting face to stabilize the cutting face and to permit the earth within the chamber 2*a* to smoothly flow into the earth intake opening of the screw conveyor. It is then necessary to provide means for preventing muddy water of high concentration from remaining in the lower portion of the chamber 2*a*. With the present embodiment, therefore, agitator blades are driven inside the chamber with the torque of the motor 35.

Figure 11:
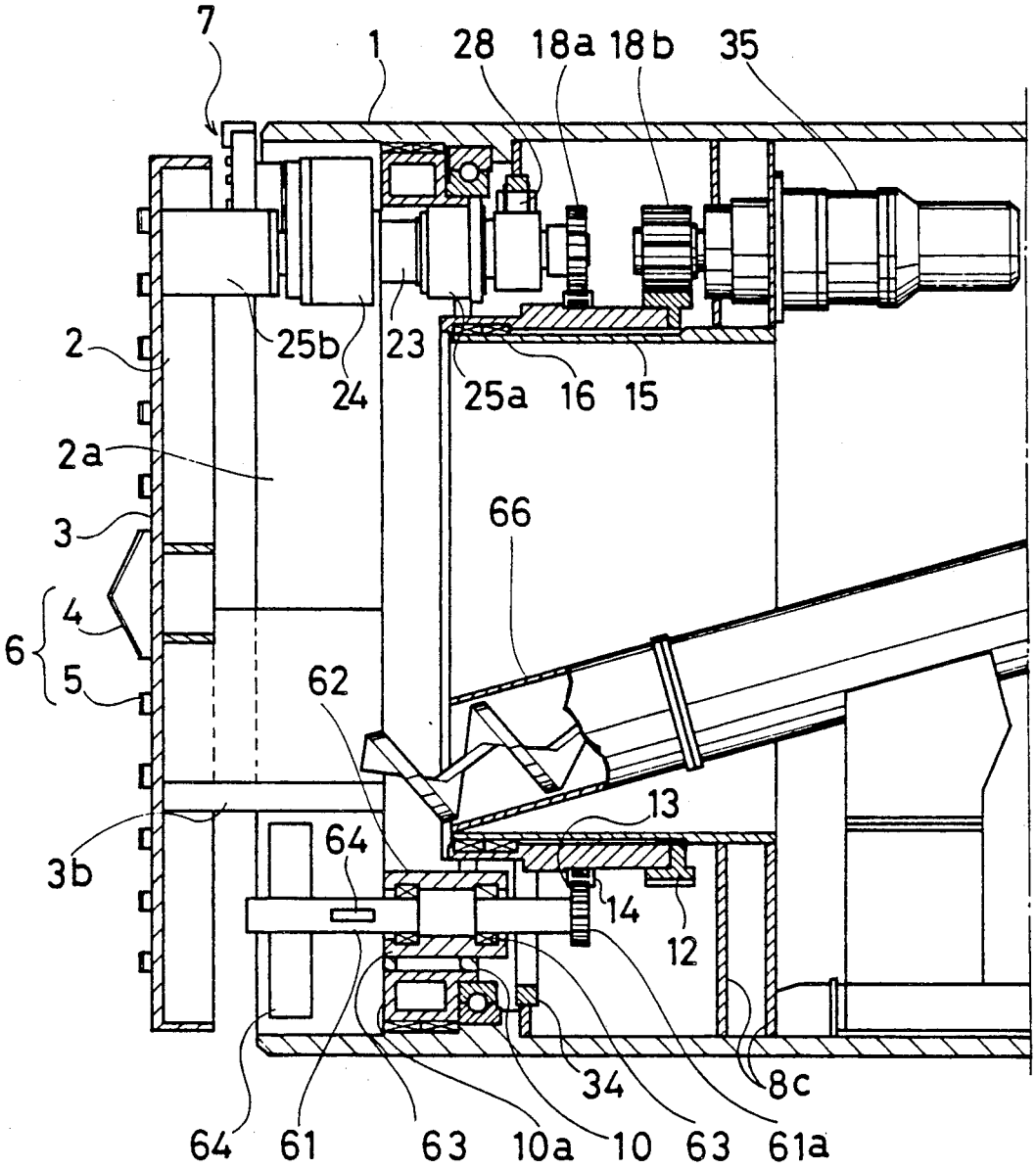
FIG. 11 is a fragmentary side elevation in section showing a shield tunneling machine as a third embodiment.

More specifically stated with reference to FIG. 11, a tubular housing 62 is supported by the rear plate 10 of the cutting wheel 2 and the ring 10*a* of box-shaped cross section The housing 62 is internally provided with a pair of front and rear bearings 63. An agitator shaft 61 is rotatably supported by the bearings 63.

The agitator shaft 61 has agitator blades 64 extending radially and attached to its front end inside the chamber 2*a*, and an agitator drive pinion 61*a* at its rear end. The pinion 61*a* is in mesh with the planetary cutter drive gear 13.

With the arrangement described, the operation of the motor 35 drives the cutting wheel 2 and the planetary cutters 7, further causing the agitator shaft 61 to rotate the agitator blades 64 while revolving the shaft 61. This prevents high-concentration muddy water from remaining in the lower portion of the chamber 2*a* and also precludes the earth from lodging in the chamber 2*a*. Moreover, these advantages are available by a simple arrangement of low cost without the necessity of providing an additional drive source. Furthermore, it is easy to provide a plurality of agitators at required portions on a circle.

Figure 12:
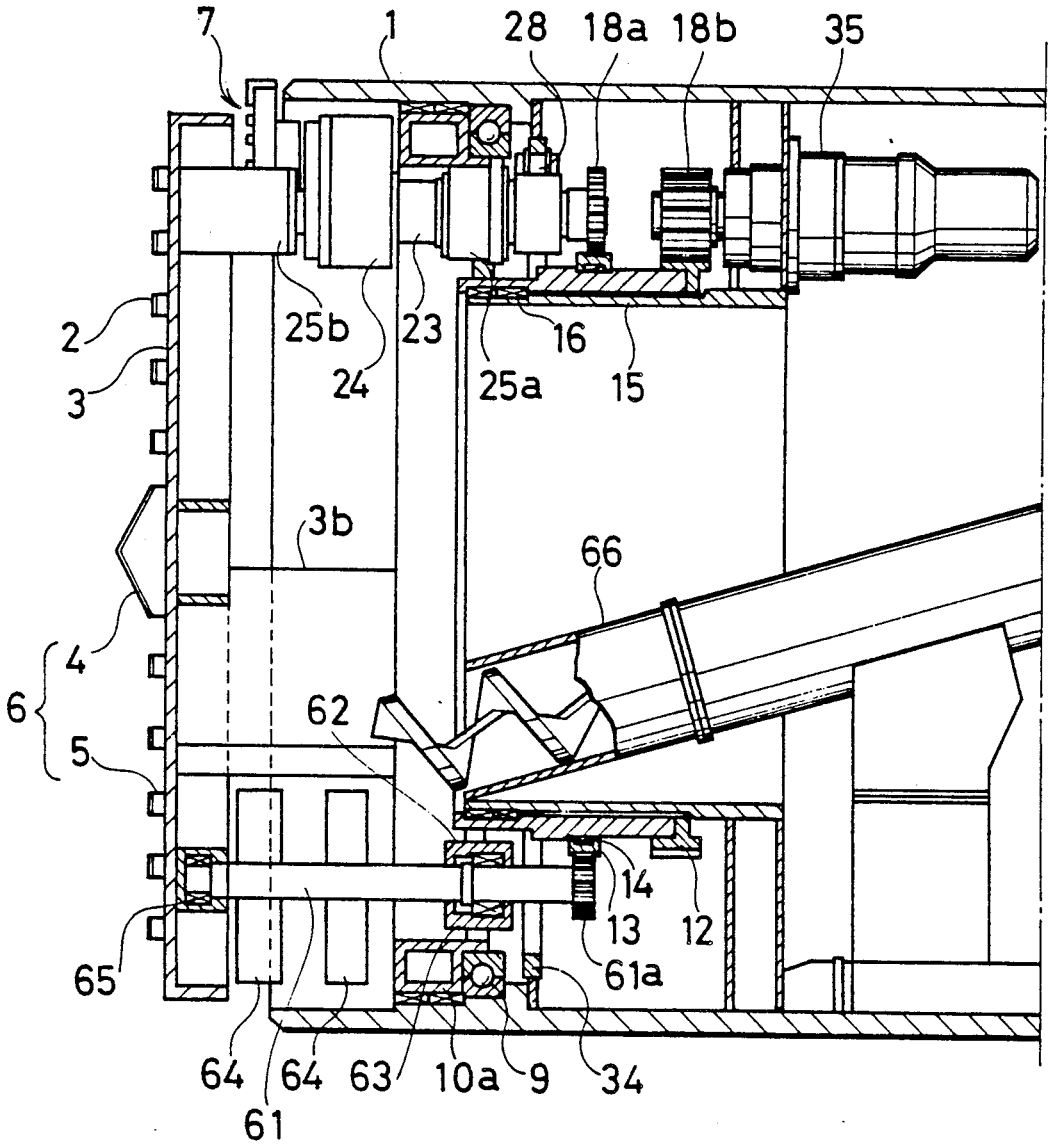
FIG. 12 is a side elevation in section showing a modification of the third embodiment.

FIG. 12 shows the agitator shaft 61 as supported at its front end by a bearing 65 provided on the front plate 3 of the cutting wheel 2. The shaft 61 can then be supported at the opposite sides of the agitator blades 64, becomes more resistant to bending and is therefore advantageous from the viewpoint of strength.

The shape, size and number of agitator blades may be determined suitably in accordance with the type of earth to be handled. For example, the same effect as above can be achieved by providing an increased number of rods to serve as blades. The agitator blades may be arranged as desired insofar as they do not interfere with other members.

Figure 8:
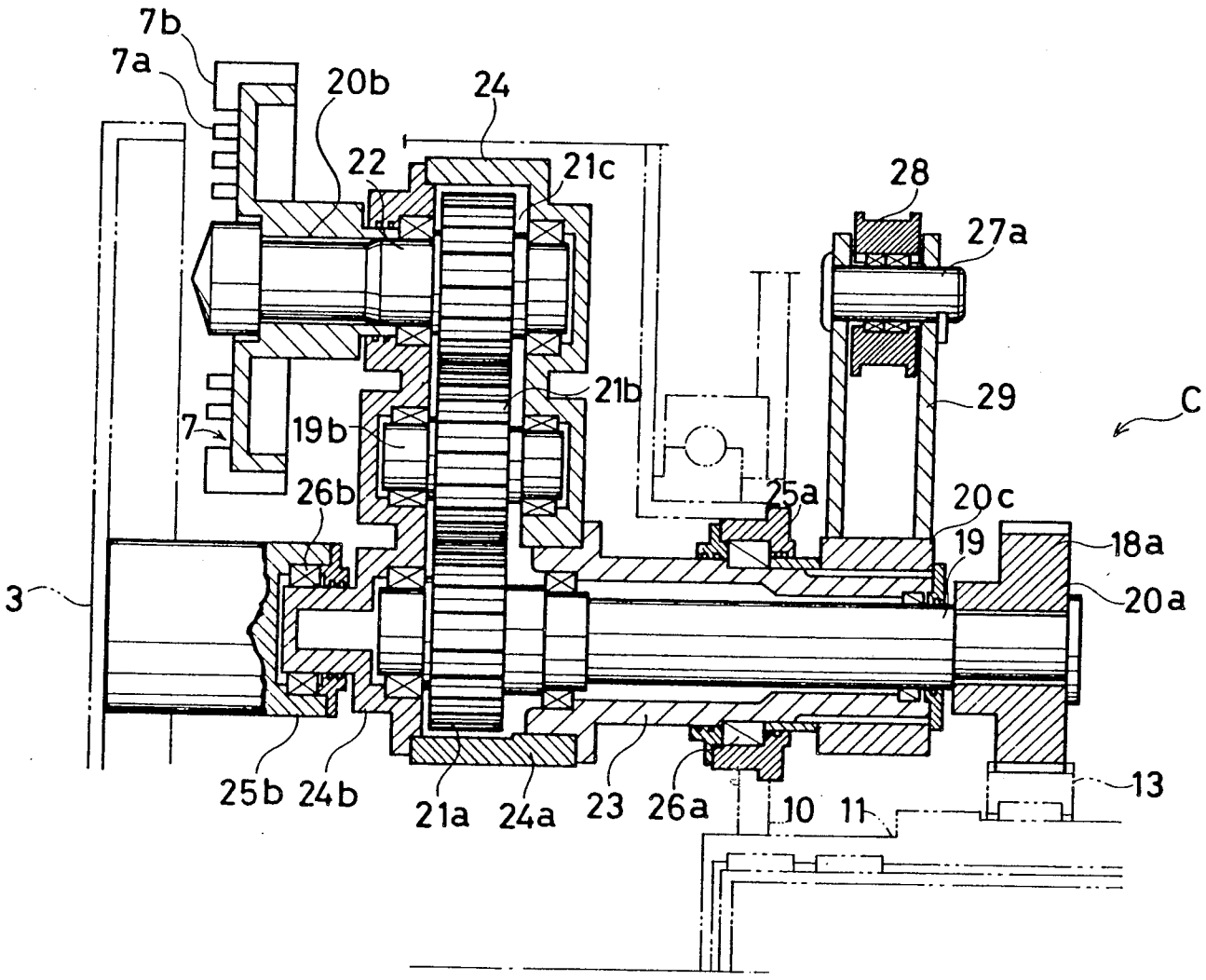
FIG. 8 is a sectional view showing a drive structure for planetary cutters in the machine.
Figure 13:
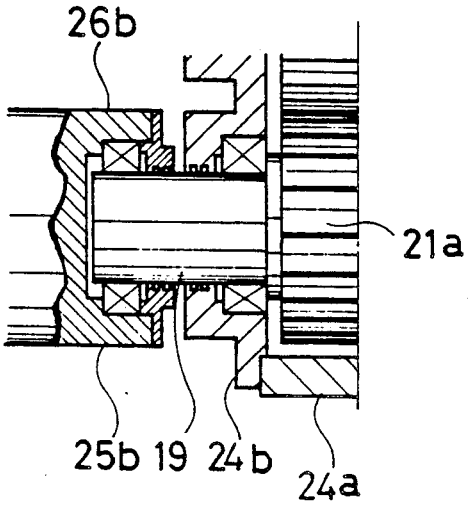
FIG. 13 and FIG. 14 are sectional views showing modifications of planetary cutter drive structure.
Figure 14:
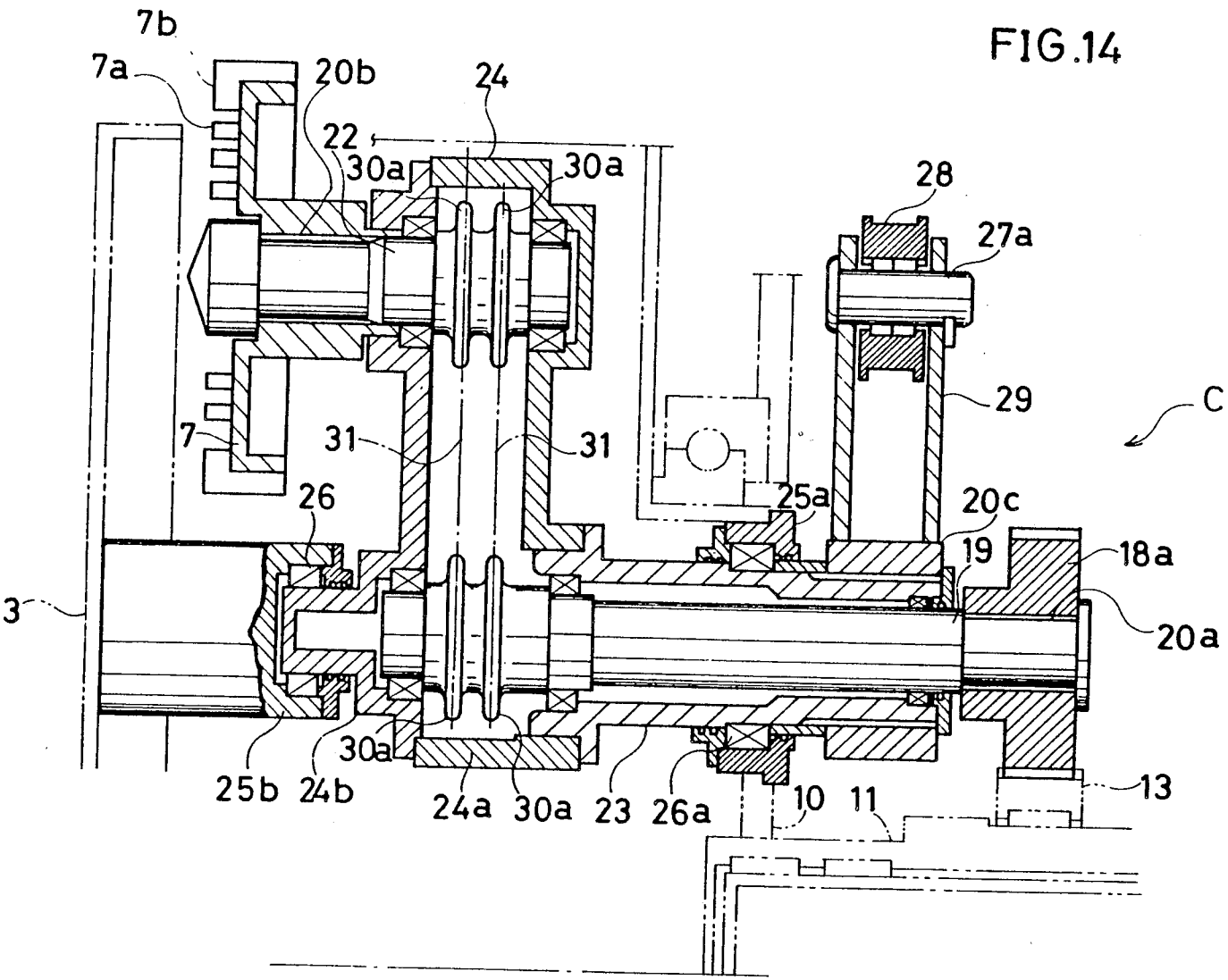

The drive conversion mechanism of the present invention is not limited to the one shown in FIGS. 3 and 8. For example, instead of providing the shaftlike projection 24c illustrated in these drawings, the front end of the drive shaft 19 may extend through the lever cover 24b for a bearing 26b to support the end of the extension as seen in FIG. 13. Further as seen in FIG. 14, the train of gears 21a to 21c may be replaced by sprockets 30a fixed to the shafts 22, 19 and chains 31 reeved around the respective pairs of sprockets, whereby the same result as already described can be achieved.

The configuration of the guide member for use in the invention is not limited to a square form like the guide member 34 but can be circular, egg-shaped, horseshoe-shaped or otherwise, as determined suitably in conformity with the desired profile of excavation.

Figure 15:
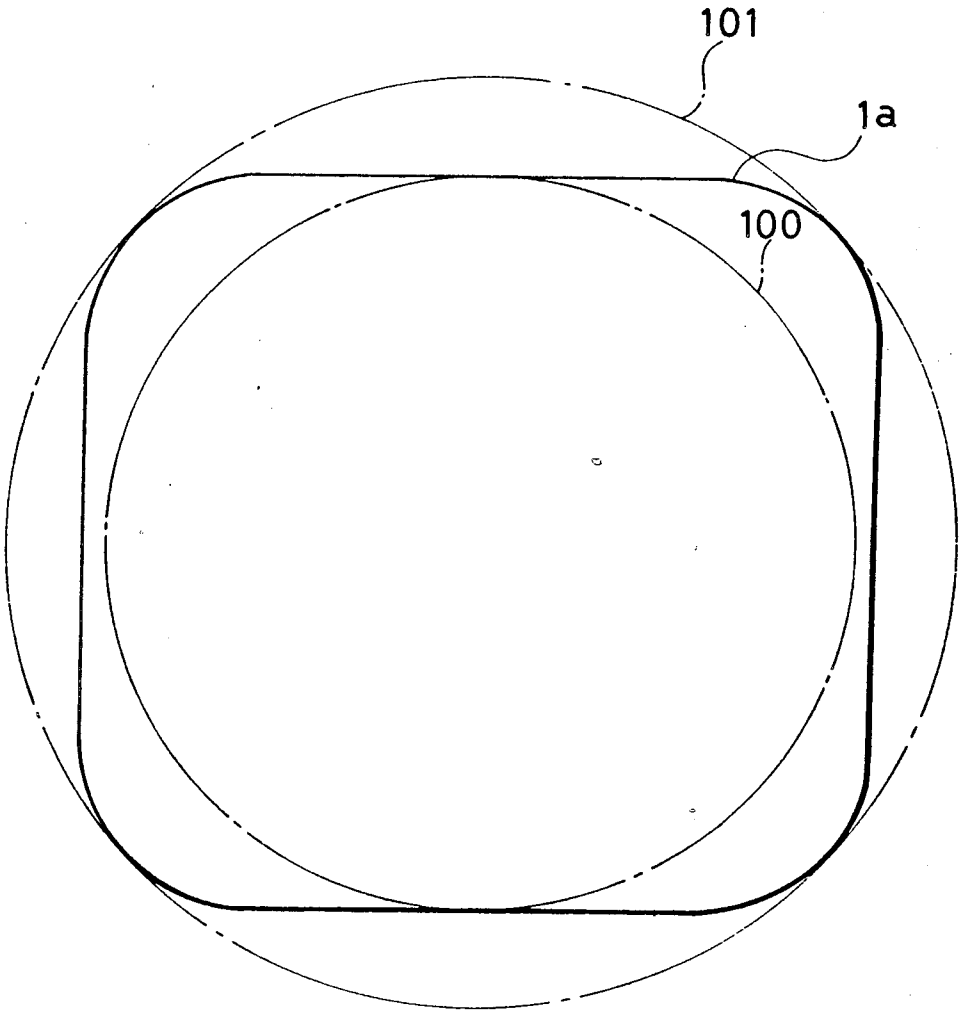
FIG. 15 is a diagram showing the range in which the locus of revolution of the planetary cutter and the outer periphery of a skin plate are to be determined.

FIG. 15 shows the outer periphery la of the skin plate 1, a small circle 100 (broken line) representing the cross sectional shape to which the ground is excavated by the rotation of the cutting wheel 2, and a large circle 101 (broken line) representing the cross sectional shape to which the ground is excavated by the rotation of the cutting wheel, with the center of each planetary cutter 7 positioned the largest distance away from the center of the small circle 100. With the present machine, the locus of revolution of the planetary cutter can be determined as desired within the range surrounded by the small circle 100 and the large circle 101. In any case, tunnels can be excavated satisfactorily using a skin plate having a cross sectional shape in conformity with that of the tunnel. While FIG. 15 shows the outer periphery la of the skin plate 1 which is in the form of a cylinder with a square cross section as an example, the diagram shows that the outer periphery of the skin plate 1 is within the above-mentioned range.

Figure 16:
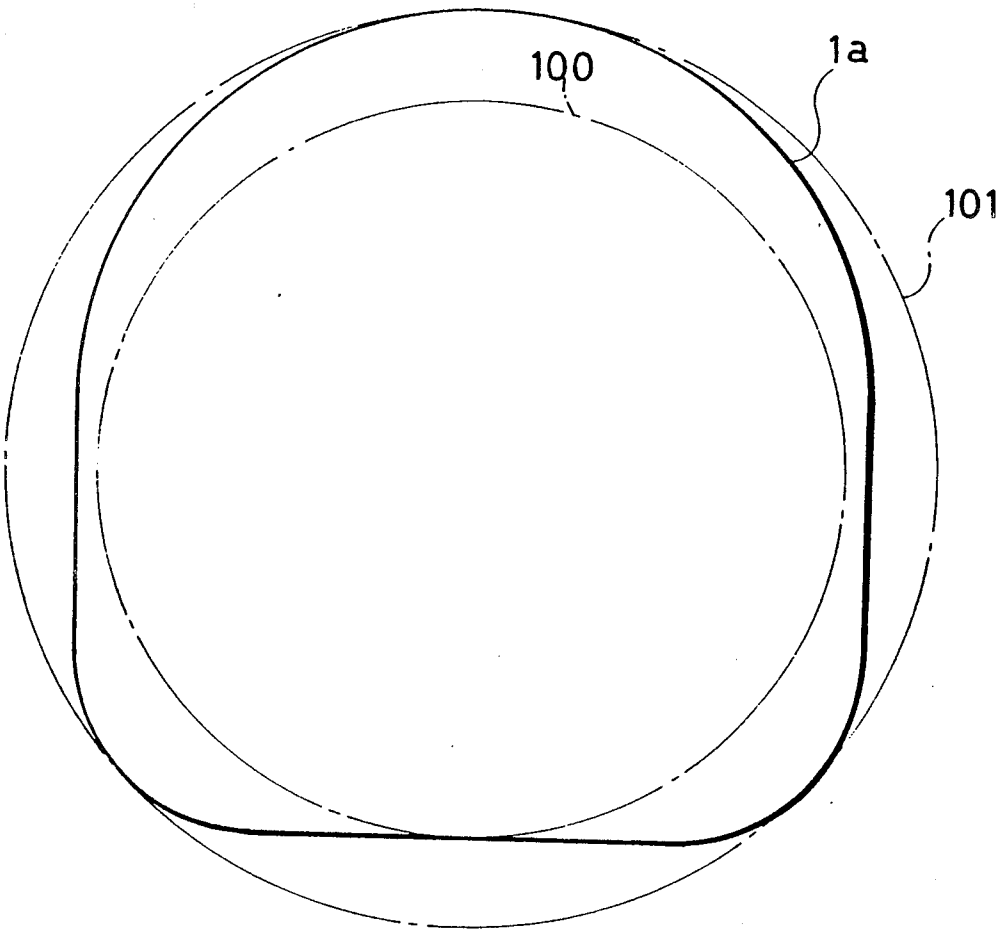
FIGS. 16 and 17 are diagrams showing other examples of outer peripheral forms of skin plate.
Figure 17:
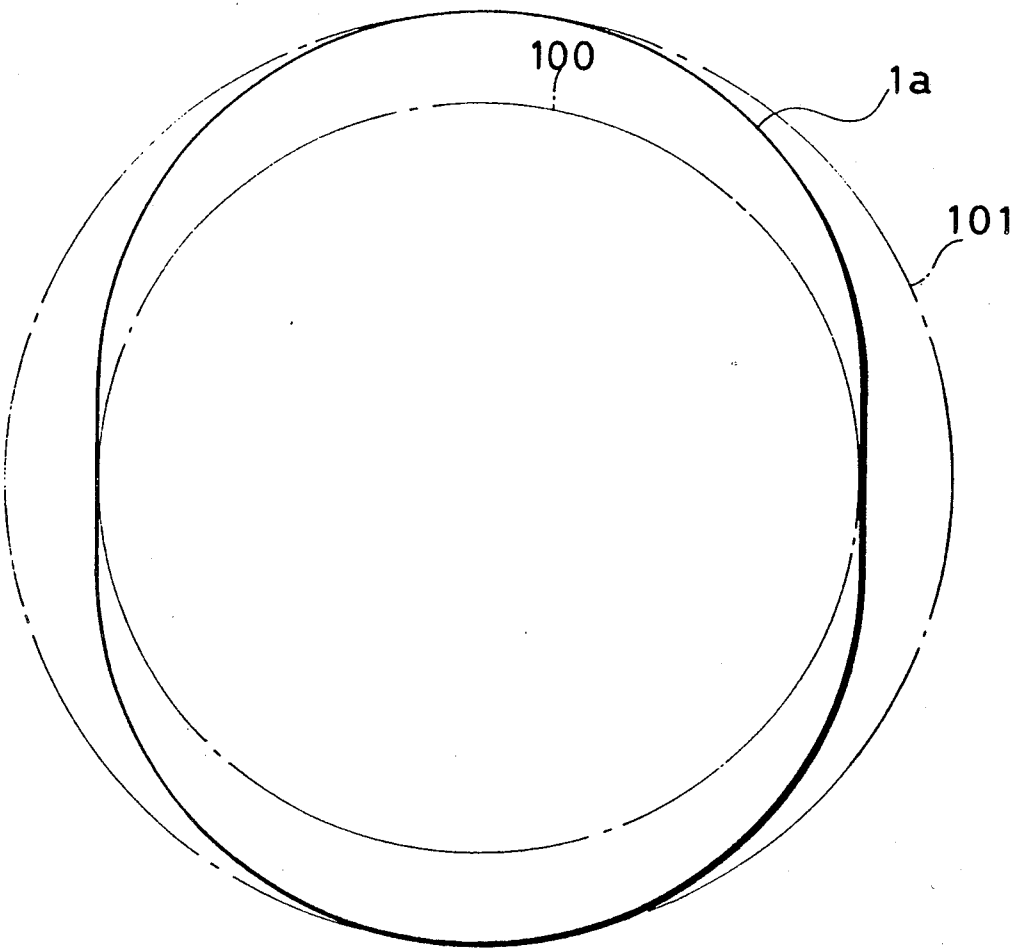

Similarly, FIGS. 16 and 17 respectively show a horseshoe-shaped periphery and a periphery in the form of an elongated circle which are within the above range. In either of these cases, the skin plate 1 to be used has a horseshoe-shaped periphery or elongated circular periphery, and the guide rail to be used is so shaped as to enable the planetary cutter to revolve along a locus conforming to the peripheral shape.

Thus, the single shield tunneling machine is adapted to readily give various profiles of excavation merely by suitably changing the shape of the guide rail and the skin plate.

The guide member, which is in the form of the guide rail 34 in the foregoing embodiments, may alternatively be in the form of an internal gear as an example, for use with a pinion meshable therewith instead of using the roller 28.

Although the stretchable member 33 is used in the foregoing embodiments as means for pressing the roller 28 against the guide rail 34, the guide rail 34 may have a double structure composed of inner and outer segments for passing the roller 28 therebetween. The stretchable member 33 can then be dispensed with.

Although the cutting wheel 2 is supported by the inner periphery of the skin plate 1 according to the above embodiments, a bearing, for example, may be fixedly provided around the fixed ring 15 shown in FIG. 2 for the bearing to support the cutting wheel 2.

Figure 18:
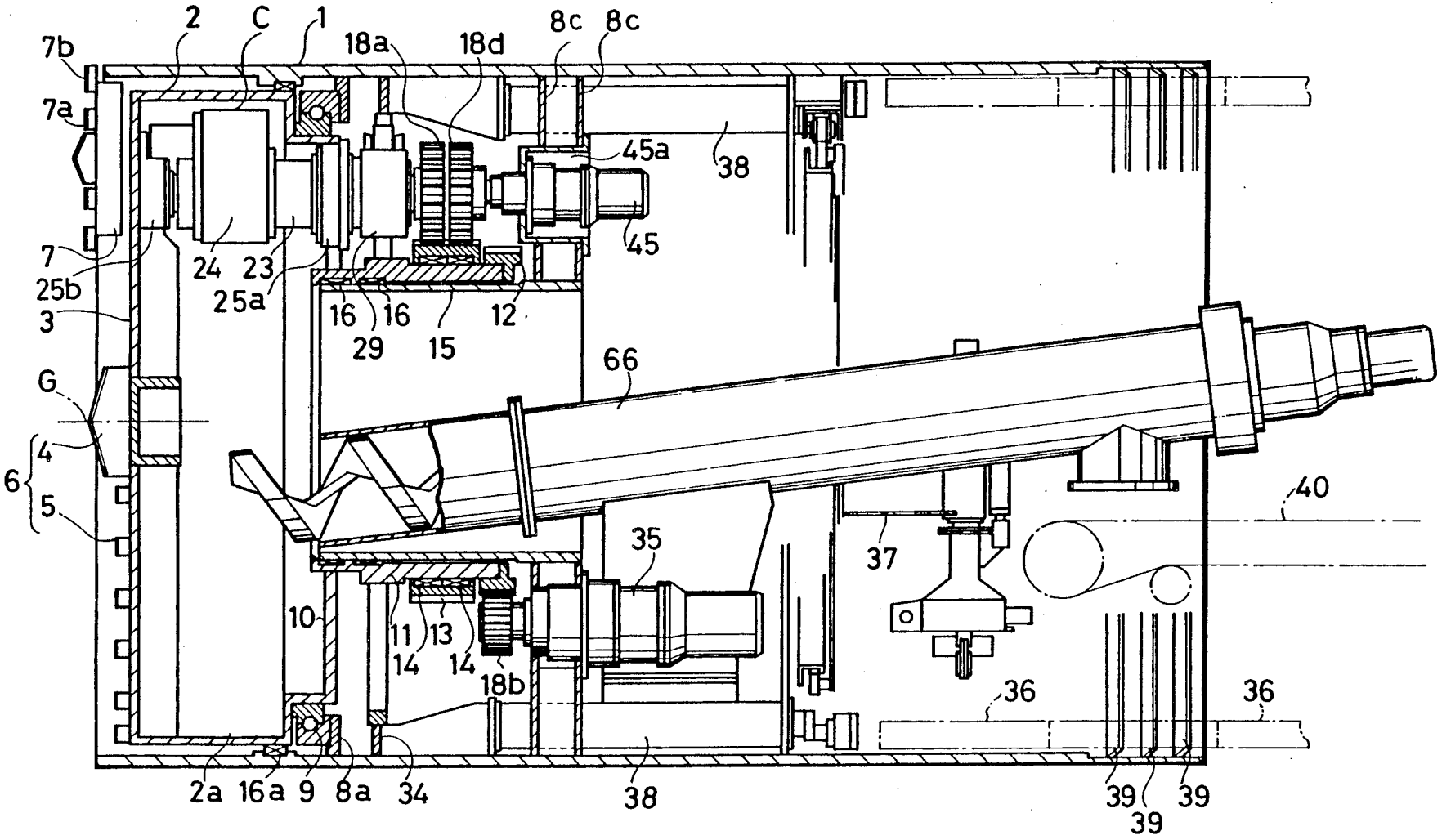
FIG. 18 is a side elevation in section showing a shield tunneling machine as a fourth embodiment.

A fourth embodiment will be described with reference to FIG. 18. Although the cutting wheel 2 and the planetary cutters 7 are driven by the motor 35 having a reduction gear and serving as a common drive source in the case of the shield tunneling machine of the first embodiment, this embodiment is so adapted that the planetary cutters 7 are driven by a motor 45 (planetary cutter drive means) with a reduction gear independently of the cutting wheel 2.

Stated more specifically, a planetary cutter drive gear 13 having an increased width is rotatably provided around the ring 11 with a bearing 14 interposed therebetween. The same pinion 18a as used in the first embodiment is in mesh with the front half portion of the gear 13. A drive pinion 18d on the drive shaft of the motor 45 is in mesh with the rear half portion of the gear 13. The motor 45 is positioned away from the motor 35 circumferentially of the ring 11 and is secured by a mount 45a to the brackets 8c.

With the present embodiment as is the case with the first embodiment described, the motor 35, when driven, rotates the cutting wheel drive gear 12, the ring 11 and the cutting wheel 2 together. Concurrently with this, the motor 45 is driven, whereby the torque is transmitted to the planetary cutter drive pinion 18a through the gear 13 and further to the rotary shaft 22 of each planetary cutter 7 through the mechanism shown in FIG. 3. Consequently, each planetary cutter 7 is driven at a speed independently of the wheel 2.

With the present embodiment, therefore, each of the planetary cutter 7 and the cutting wheel 2 is settable to a speed of rotation independently of the other by setting the motors 35, 45 to suitable speeds of rotation individually. Accordingly, the cutter 7 is rotatable at a desired speed, for example, according to the type of the earth to be worked on, independently of the speed of the cutting wheel 2.

Figure 19:
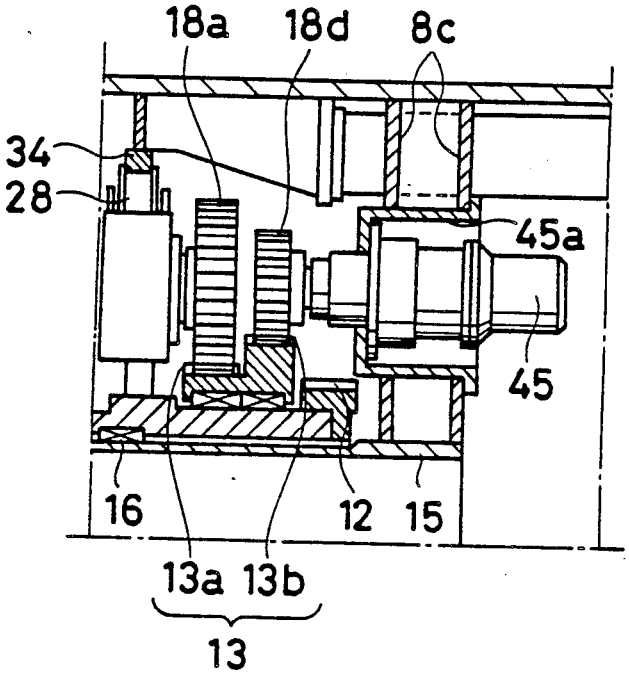
FIG. 19 is a side elevation in section showing a modification of the same.

The planetary cutter drive gear 13 may have a double structure comprising a front (first) gear 13a and a rear (second) gear 13b as seen in FIG. 19. The front gear 13a is in mesh with the planetary cutter drive pinion 18a, and the rear gear 13b with the drive pinion 18d. The reduction ratio for the planetary cutter 7 is then suitably settable by varying the gear ratio between the two gears 13a, 13b.

With the present embodiment, the planetary cutter 7 can be driven either forward or reversely, so that the drive mechanism C, the lever 24, etc. can be designed easily free of the restriction to be imposed by the direction of rotation of the cutter 7. Furthermore, it is possible to remove the stones or the like biting in between the periphery of the cutter 7 and the skin plate 1, or to correct rolling during excavation, by changing the direction of rotation of the cutter 7.

The means included in the second or third embodiment or other modifications can of course be incorporated into the fourth embodiment.

A fifth embodiment will be described next with reference to FIGS. 20 to 22.

Figure 20:
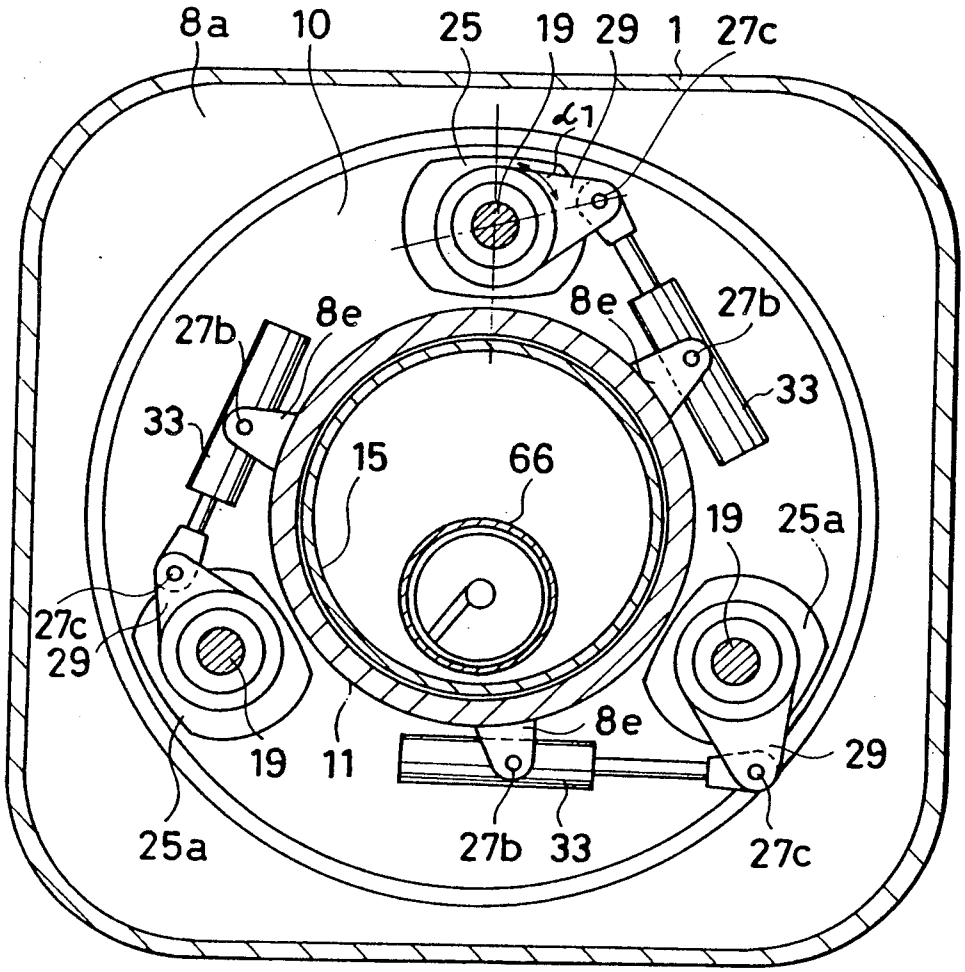
FIG. 20 is a front view in section showing a shield tunneling as a fifth embodiment.

With the foregoing embodiments, the roller 28 on the outer end of the lever 29 is pressed against the guide rail 34 by the stretchable member 33 to thereby cause the planetary cutter 7 to revolve along the desired locus, whereas with this embodiment, the guide rail 34 is dispensed with as seen in FIG. 20. The cutter 7 is adapted to revolve along the desired path by controlling the operation of the stretchable member 33 by the drive control system shown in FIG. 21.

Figure 21:
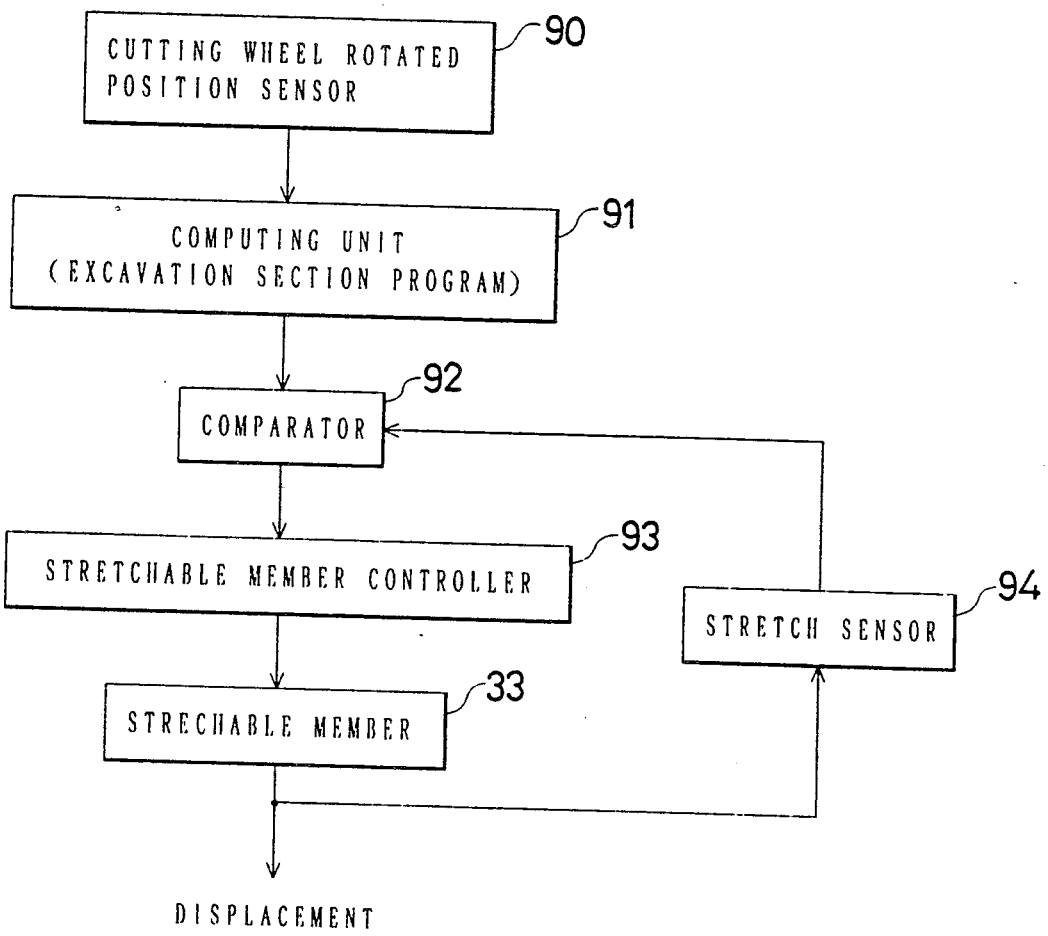
FIG. 21 is a block diagram showing a drive control system included in the machine.

Referring to FIG. 21, a cutting wheel (rotary body) rotated position sensor 90 detects the rotational displacement (e.g. angle) of the cutting wheel 2 from a suitable reference position thereof (e.g. the position shown in FIG. 1).

A stretch sensor 94 for the stretchable member 33 (sensor for detecting the moved position of the pivotal member) detects the amount of actual stretch or contraction of the stretchable member 33 relative to a reference length of the member 33 suitably determined. The sensor 94 comprises a potentiometer or the like. Thus, the sensor 94 detects the pivotally moved position of the pivotal member. The reference length to be determined is, for example, the length of the stretchable member 33 when the control lever 29 is in the position shown in FIG. 1.

A computing unit 91 has stored therein a program for calculating the amount of stretch or contraction of the stretchable member 33 required relative to the rotational displacement of the cutting wheel in order to excavate a predetermined cross section. Thus, the unit 91 instantaneously calculates the amount of stretch or contraction required of the member 33 relative to the rotational displacement of the wheel 2 received from the rotated position sensor 90 as will be described later below.

A comparator 92 compares the displacement received from the stretch sensor 94 with the required displacement received from the computing unit 91, feeds a stretching or contracting command to a stretchable member controller 93 to eliminate the difference therebetween, and gives a stop command upon the elimination of the difference.

The stretchable member controller 93 controls the actual stretch or contraction of the member 33. For example when the stretchable member 33 comprises a hydraulic cylinder, the controller 93 comprises a servo vale for controlling the supply of oil to the cylinder, and a control device for the servo valve. The controller 93 and the comparator 92 constitute comparative control means.

With the present embodiment as in the foregoing embodiments, the cutting wheel 2 is drivingly rotated, while the drive control system controls the operation of each stretchable member 33 so that the planetary cutter 7 revolves along the desired locus.

First, the computing unit 91 calculates the amount of stretch or contraction of the stretchable member 33 required to obtain the desired cross section relative to the rotated position of the cutting wheel 2. Based on the result of comparison of the actual stretch or contraction amount with the calculated amount, the operation of the stretchable member 33, i.e. the drive of the pivotal member comprising the control lever 29, etc. is controlled.

Stated more specifically, suppose the planetary cutter 7 is positioned as opposed to the corner of the skin plate 1. The stretchable member 33 is then stretched to increase the distance from the axis G to the cutter 7 (i.e., radius of revolution) to thereby increase the region to be excavated by the cutter 7 to the corner portion. If the planetary cutter 7 is positioned as opposed to the midpoint of the side of the square skin plate 1, the member 33 is contracted to decrease the distance from the axis G to the cutter 7. The control thus effected enables the planetary cutter 7 to revolve along a locus in conformity with the desired profile of excavation (generally square to rectangular in this case).

With the shield tunneling machine thus constructed, the ground is excavated in a circular form with the center cutter 6, and the ground portion around the circular portion is excavated with the planetary cutters 7, whereby a tunnel can be excavated which has the desired cross section in its entirety. With this machine, each pivotal member is controlled by the drive control system to thereby revolve the planetary cutter 7 along the desired locus, so that the ground can be excavated with various cross sectional shapes merely by changing the program stored in the computing unit 91.

The ground can be overcut with use of the control system advantageously as will be described below with reference to FIG. 22.

The drawing shows hatched regions J, K, L and M around the outer periphery 1*a* of the skin plate 1 which are to be overcut. In the usual mode of excavation, the planetary cutters 7 are so controlled as to move along the outer periphery of the skin plate 1 according to the program stored in the computing unit 91. In addition to this program for realizing the above movement, the computing unit 91 has stored therein a program for moving each planetary cutter 7 along a profile 96*a* including the region J around the skin plate periphery, and respective programs for moving the cutter 7 along a profile 96*b* including the region K, along a profile 96*c* including the region L and along a profile 96*d* including the region M. The computing unit 91 is provided with a circuit for selecting one of the five programs as desired to specify one of the five profiles of excavation as required. The control system thus constructed achieve the following advantage of overcutting.

For example, when the program for usual excavation profile is changed over to the program for the profile 96*a*, the ground portion above the upper side of the skin plate 1 is also excavated for overcutting. When the excavation operation is continued in this state, a space with a cross section corresponding to the region J above the skin plate 1 is formed, and the frictional resistance between the plate 1 and the earth decreases in this portion. On the other hand, the bottom of the skin plate 1 remains in contact with the ground. Accordingly, the difference in frictional resistance between the portion above the skin plate 1 and the portion below the plate 1 gradually increases, consequently permitting the machine to escape toward the upper side where the resistance is lower. Thus, the machine is propelled gradually upward.

Figure 22:
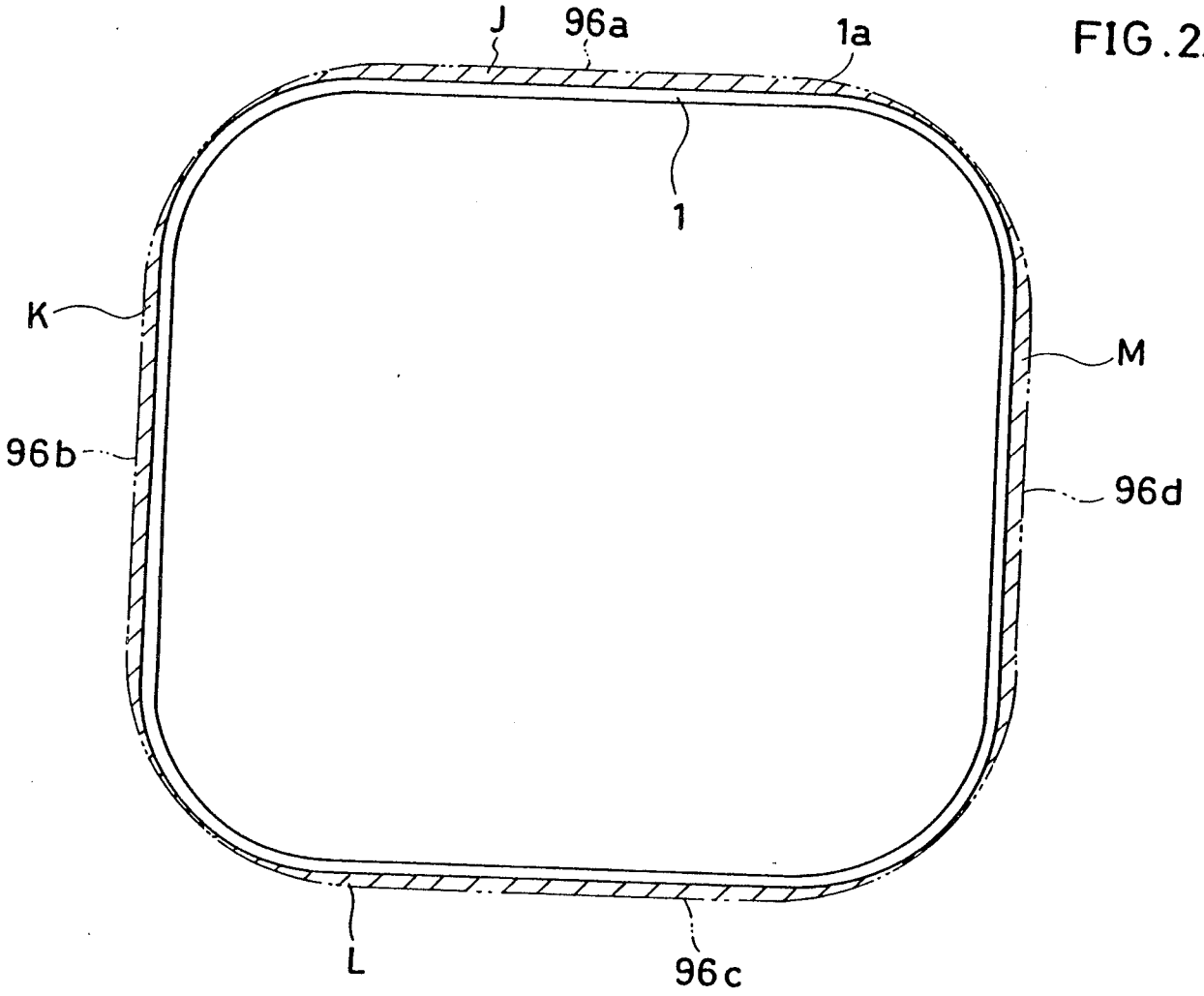
FIG. 22 is a diagram showing the region to be overcut by the machine.

Since the machine tends to alter its orientation toward the overcutting side, the direction of advance of the machine is easily variable upward, downward, leftward or rightward by suitably selecting one of the excavation programs for the profiles 96*a* to 96*d* shown in FIG. 22, the machine thus adapted to excavate the ground along steep curves. Further if the computing unit has stored therein programs for overcutting the respective four corners, the posture of the machine can be easily corrected against rolling.

The means included in the second to fourth embodiments can also be incorporated into the present embodiment. According to the fourth embodiment, for example, each planetary cutter 7 is driven by the motor 45 independently of the cutting wheel 2. In this case, the stretchable member 33 may be operated under the control of the drive control system to obtain the same advantage as above.

A sixth embodiment of the invention will be described with reference to FIGS. 23 to 27.

Figure 23:
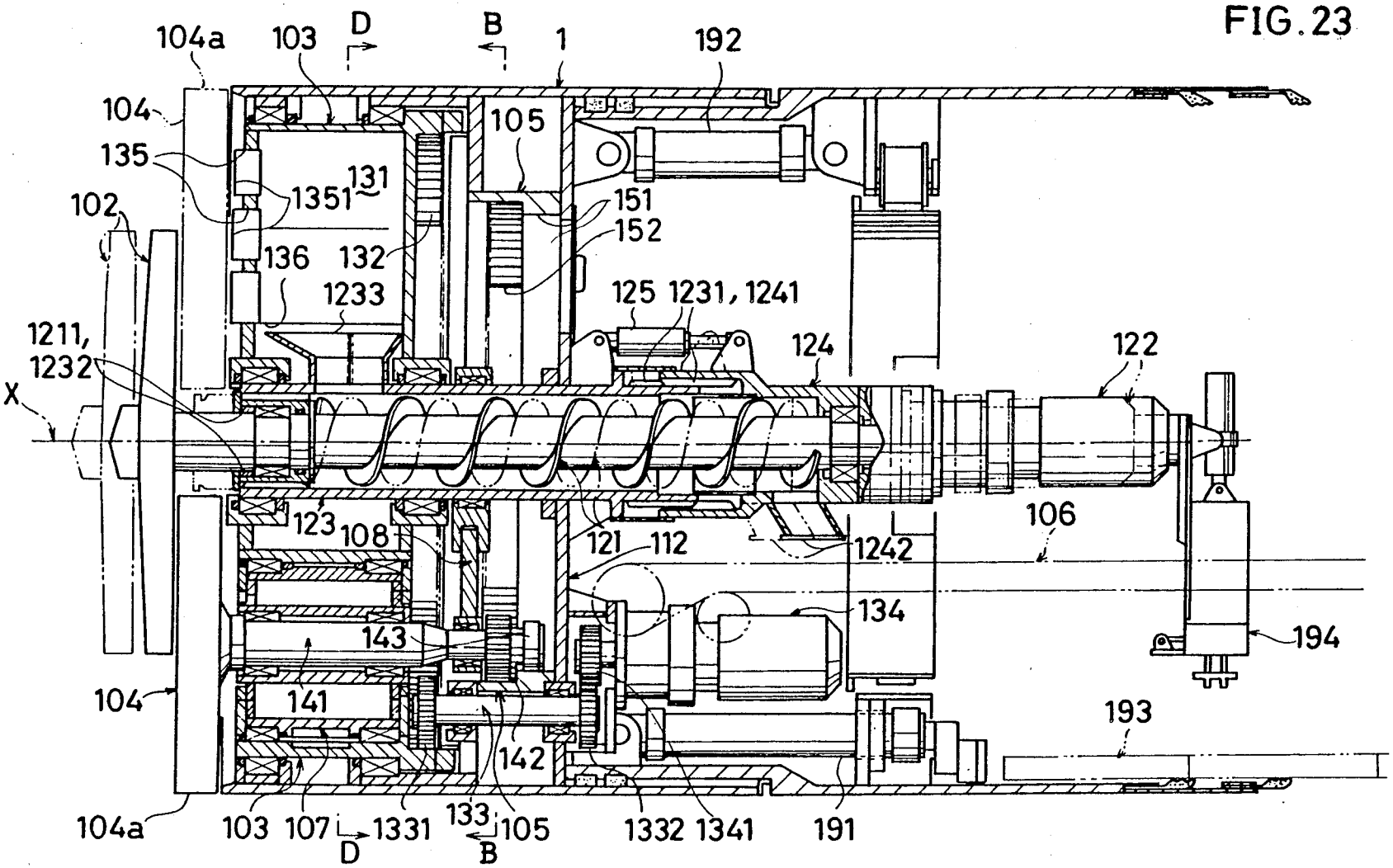
FIG. 23 is a side elevation in section showing a shield tunneling machine as a sixth embodiment.
Figure 24:
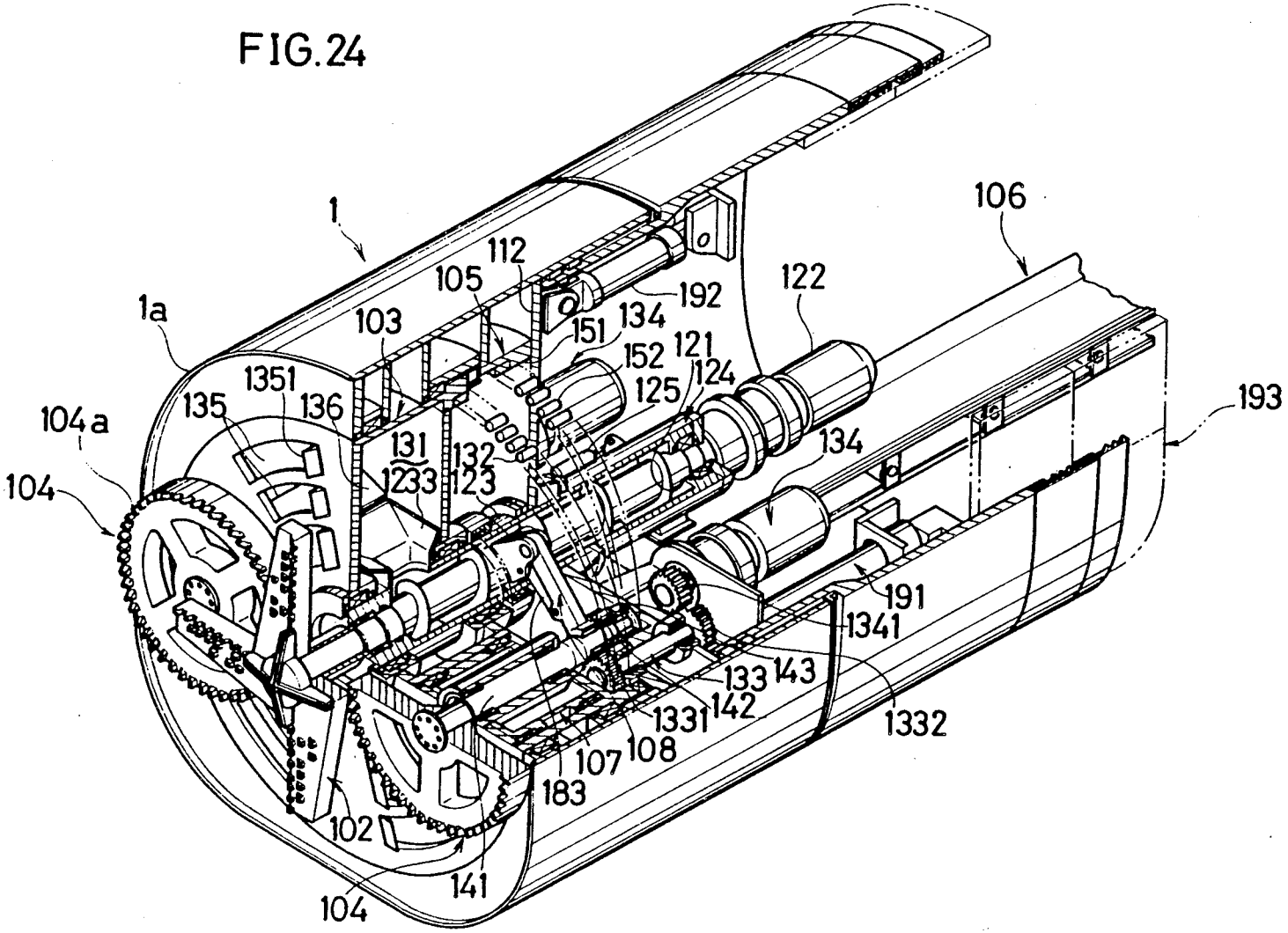
FIG. 24 is a perspective partly broken away and showing the machine.
Figure 25:
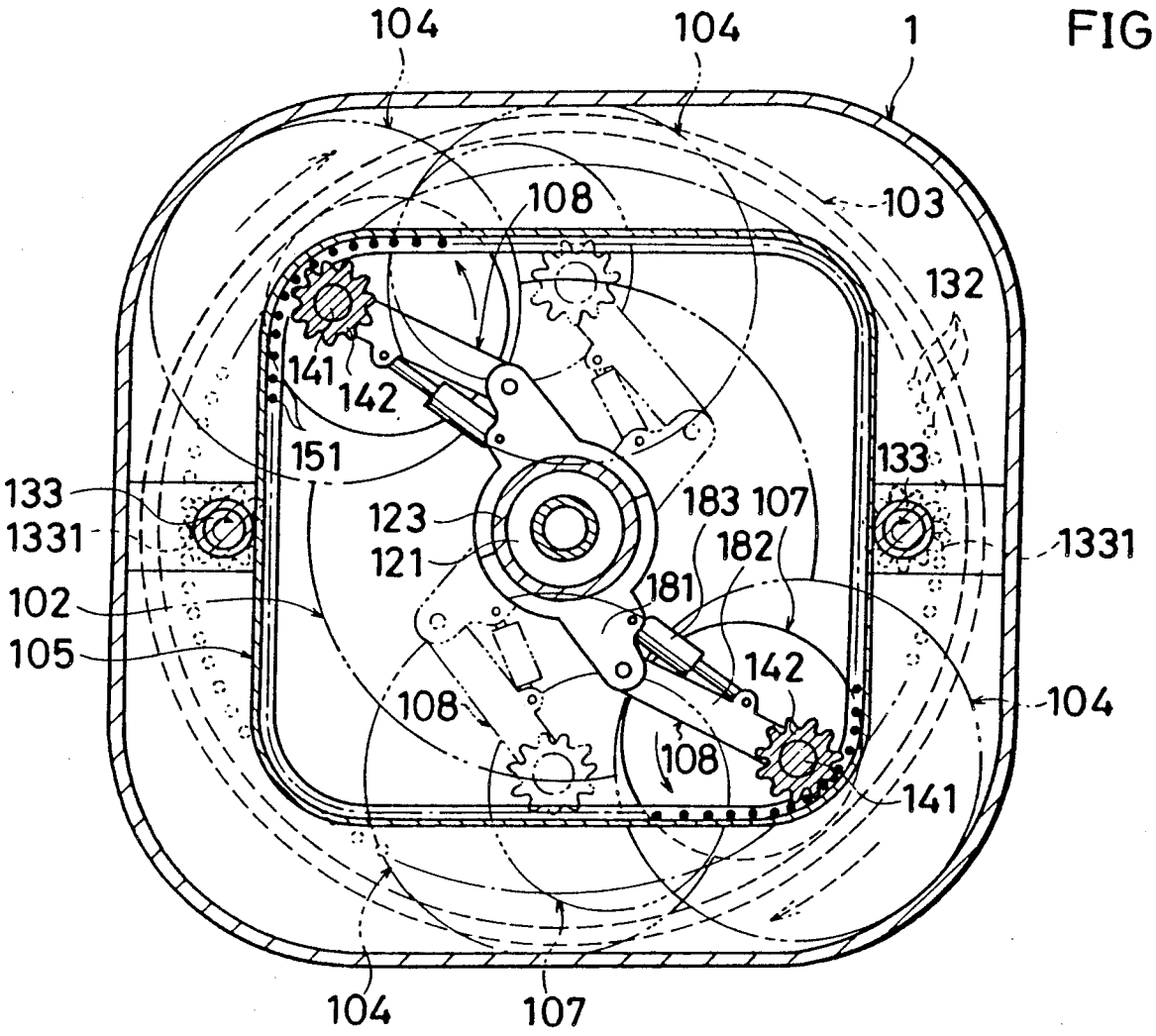
FIG. 25 is a view in section taken along the line B—B in FIG. 23.
Figure 26:
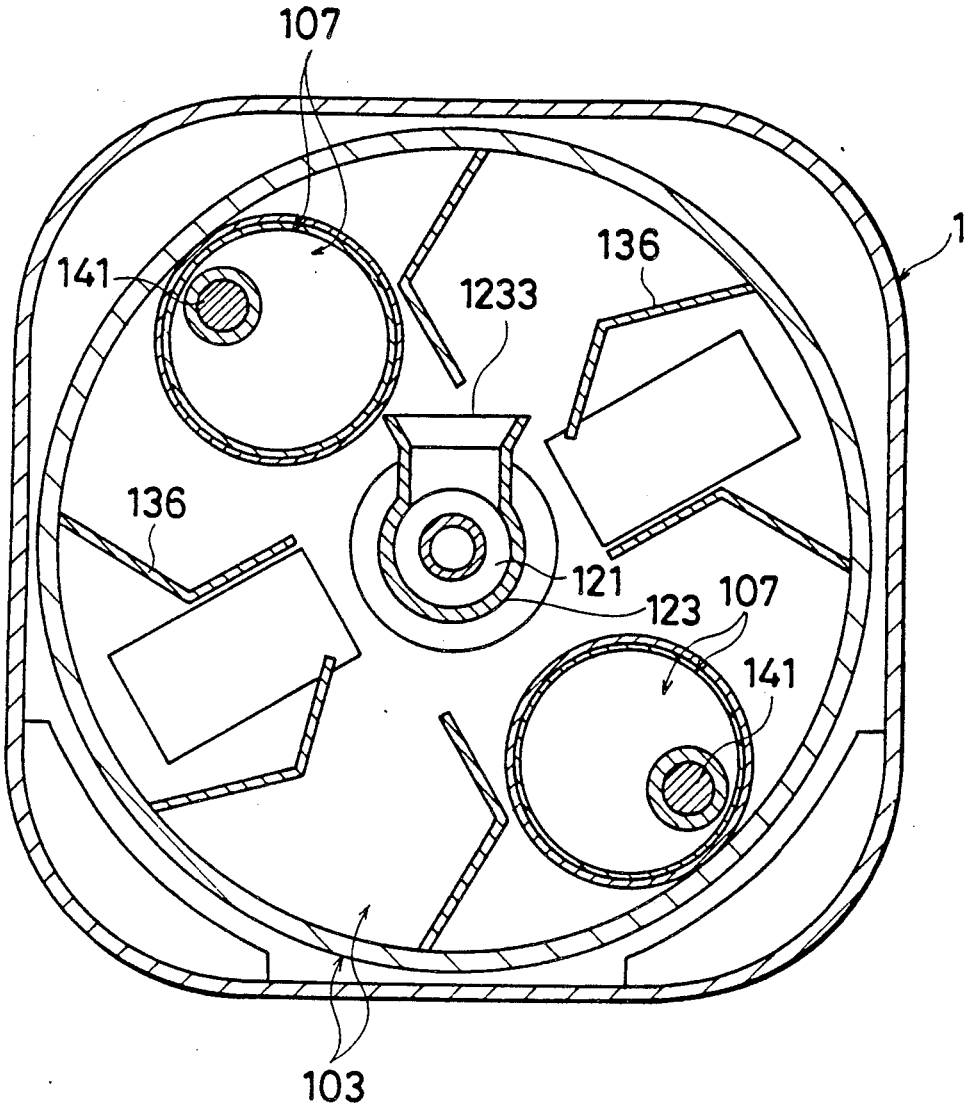
FIG. 26 is a view in section taken along the line D—D in FIG. 23.
Figure 27:
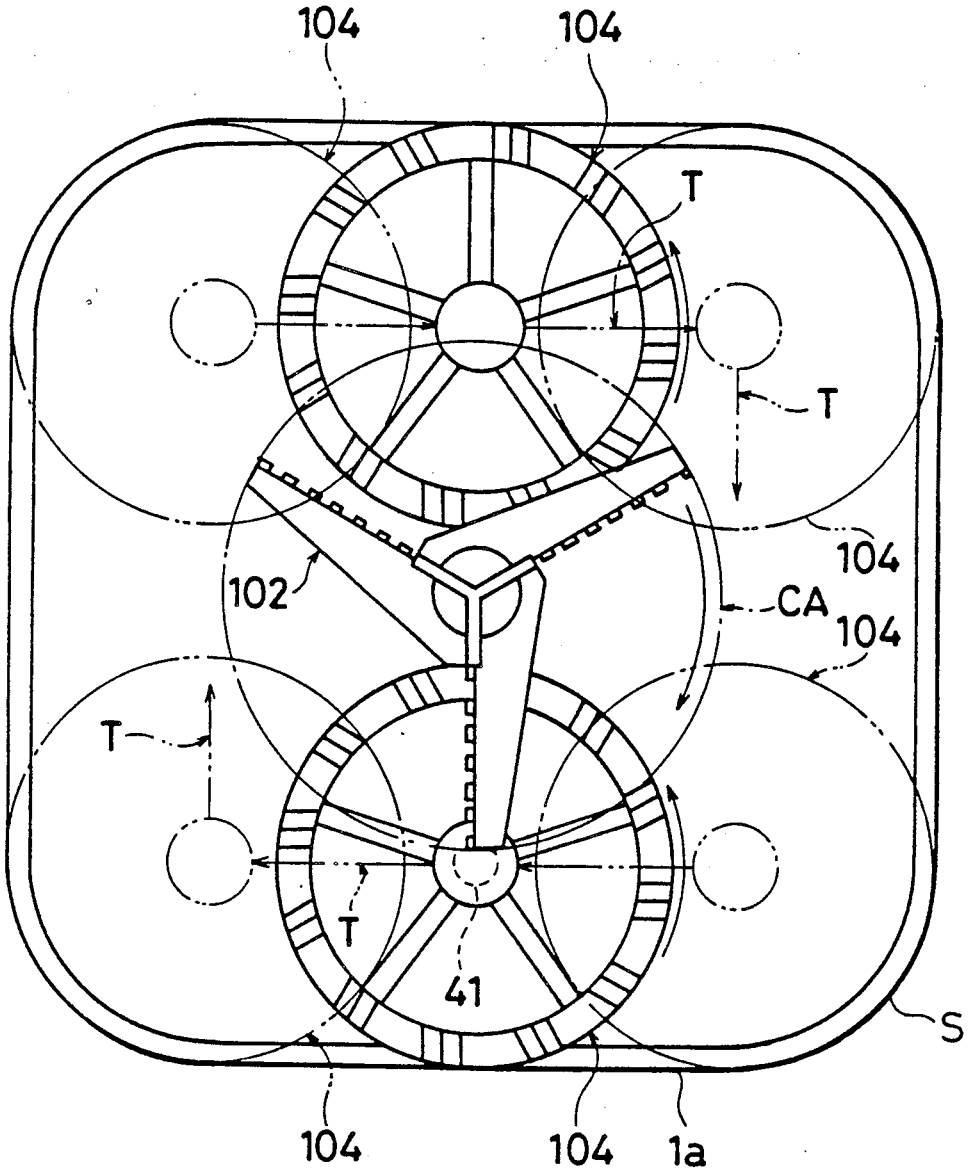
FIG. 27 is a front view of the machine.

The shield tunneling machine shown in FIGS. 23 to 25 consists essentially of a skin plate 1 having a square to rectangular cross section, a center cutter 102 so supported as to be rotatable about the horizontal central axis X of the skin plate 1 (center cutter axis extending in the direction of propulsion of the machine), a large rotary table (rotary body) 103 rotatable about the center cutter axis X, a pair of side cutters (planetary cutters) 104 arranged around the center cutter 102 and each rotatable about an axis parallel to the cutter axis X, and a guide frame 105 for guiding the movement of the rotary shaft 141 of the side cutter 104.

The center cutter 102 is connected to the front end of a screw conveyor 121. An electric motor 122 for the center cutter 102 is attached to the rear end of the conveyor 121. The center cutter 102 and the screw conveyor 121 are rotatable about the axis X at the same time by the operation of the motor 122.

The screw conveyor 121 is covered with a fixed tube 123 secured to the skin plate 1 and a movable tube 124 having the motor 122 attached thereto and has its rear end rotatably supported by the movable tube 124. The movable tube 124 and the fixed tube 123 are splined to each other as at 1231, 1241 and are movable along the cutter axis X relative to each other. The screw conveyor 121 is splined to the fixed tube 123 as at 1211, 1232 at their front ends and is movable relative to the tube 123 along the axis X. The movable tube 124, the screw conveyor 121 and the center cutter 102 are movable forward and rearward between a usual position (indicated in solid line in FIG. 23) and a projected position (indicated in two-dot-and-dash line in FIG. 23) by the extension or contraction of a cylinder 125 connected between the movable tube 124 and the skin plate 1.

The fixed tube 123 is provided on the upper side of its front end with a hopper 1233 which is opened to the interior space 131 of the large table 103, while the movable tube 124 is formed in the bottom side of its rear end with a discharge opening 1242 positioned above a belt conveyor 106. The muck led into the large table 103 is discharged onto the belt conveyor 106 by the operation of the screw conveyor 121.

The large rotary table 103 is supported by the outer periphery of the fixed tube 123 and the inner periphery of the skin plate 1 rotatably about the center cutter axis X. The large table 103 is provided with a pair of small rotary tables 107 arranged symmetrically with respect to the axis X. Each of the small tables 107 is supported by the large table 103 rotatably about an axis parallel to the center cutter axis X. A side cutter rotary shaft 141 is supported by the small table 107 eccentrically therewith and is rotatable about an axis parallel to the axis X.

The rotary shaft 141 fixedly carries the side cutter 104 at its front end and has a guide gear 142 and a roller 143 attached to its rear end. Fixed to the inner periphery of the skin plate 1 is the guide frame (regulating member) 105 which is square to rectangular and similar in shape to the outer periphery of the skin plate 1. The guide frame 105 is formed with a guide portion 151 along its inner periphery and has a gear 152 comprising a multiplicity of pins arranged on the inner periphery. The side cutter rotary shaft 141 is so disposed that the guide gear 142 is in mesh with the pin gear 152, with the roller 143 in contact with the guide portion 151.

The side cutter 104 and the guide frame 105 are so sized that when the guide gear 142 is in mesh with the pin gear 152, the outer periphery of the side cutter 104 is positioned at the front-side outer periphery la of the skin plate 1. The side cutter 104 is further so sized that the locus circle of rotation of the center cutter 102 partly laps over the locus circle of rotation of the side cutter 104.

The fixed tube 123 is provided on its outer periphery with a pair of support arms (pivotal member) 108 rotatably about the tube 123. The side cutter rotary shaft 141 is rotatably connected to the outer end of each support arm 108. As shown in FIG. 25, the support arm 108 comprises a pair of arm portions 181, 182 pivoted to each other, and an air cylinder 183 connected between the arm portions 181, 182. The side cutter rotary shaft 141 is pressed against the pin gear 152 on the guide frame 105 by the stretching force of the air cylinder 183, whereby the guide gear 142 is forced into meshing engagement with the pin gear 152 regardless of the position of the rotary shaft 141 relative to the guide frame 105.

A multiplicity of pins are arranged along the inner periphery of the large rotary table 103 at its rear end to provide a pin gear 132. A transmission shaft 133 rotatably supported by the skin plate 1 has at its one end a gear 1331 meshing with the pin gear 132 and at the other end thereof a gear 1332 meshing with an output gear 1341 on a side cutter electric motor 134. The large table 103 is rotatable about the center cutter axis X by the torque of the motor 134 transmitted through the shaft 133.

The large table 103 is formed in its front plate with a plurality of muck inlets 135 as arranged radially. A plurality of scraper plates 136 (see FIG. 26) are radially arranged in the interior space 131 of the large rotary table 103 for placing the muck into the hopper 1233.

FIG. 23 further shows a shield jack 191, a slide jack 192, segments 193 and a segment assembling erector 194.

With the shield tunneling machine, the side cutter motor 134, when driven, transmits a torque to the large rotary table 103 through the transmission shaft 133 and the pin gear 132, rotating the large table 103 about the cutter axis X clockwise in FIG. 25. With this rotation, the small rotary tables 107 and the side cutter rotary shafts 141 revolve about the axis X.

At this time, the guide gear 142 on each side cutter rotary shaft 141 is in mesh with the pin gear 152 of the guide frame 105, with the roller 143 in contact with the guide portion 151, so that the revolution of the small table 107 about the center cutter axis X revolves the side cutter shaft 141 and the side cutter 104 with the table 107. Moreover, since the shaft 141 is mounted on the small table 107 eccentrically therewith, the rotation of the large table 103 also rotates the small table 107 about the shaft 141 counterclockwise in FIG. 25, whereby the variation in the distance from the axis X to the guide frame 5 is absorbed.

During the above movement, the guide gear 142 is pressed against the pin gear 152 on the guide frame 105 by the air cylinder 183 on the support arm 108 and therefore properly rotates and moves along the inner periphery of the guide frame 105, with the result that the locus of revolution of the side cutter shaft 141 conforms to the shape of the inner periphery of the guide frame 105.

The operation of the center cutter motor 122 rotates the center cutter 102 in a direction opposite to the direction of rotation of the side cutter 104 to excavate the cutting face in front of the machine into a circular portion CA (see FIG. 27) centrally thereof. At the same time, the ground is excavated at the region between the circular portion CA and the square contour S of cross section of the tunnel defined by the outer periphery la of the front side of the machine, by each side cutter 104 which revolves along a substantially square locus T along the guide frame 105 while rotating about its own axis.

With the shield tunneling machine described above, the cutting face in front of the machine can be excavated with a cross section (e.g. square cross section in the present case) other than a circular one continuously, whereby a tunnel having this cross section can be formed. Thus, the ground can be excavated with the cross sectional configuration required of the tunnel without necessitating excessive excavation. This results in a corresponding cost reduction.

The muck led into the large rotary table 103 through the inlets 135 in the front plate of the table 103 during excavation is thrown into the hopper 1233 by the scraper plates 136, transported rearward by the screw conveyor 121 and delivered onto the belt conveyor 106 through the discharge opening 1242. With respect to the speed and direction of rotation, each side cutter 104 is made different from the large table 103, and the side cutter 104 is made different from the center cutter 102, whereby the muck to be taken in through the inlets 135 can be ground between the rear face of the center cutter 102 and the front face of the side cutter 104 and between the rear face of the side cutter and blades 1351 on the front side of front wall of the table 103 at the inlets 135. Accordingly, the machine has the advantage that it need not be equipped with a crusher.

Further with the present tunneling machine, the center cutter 102 differs from each side cutter 104 in the direction of rotation, so that the rotational reaction forces thereof are offset by each other, whereby the machine can be prevented from rotation.

Should such rotation occur, the cylinder 125 is contracted to thereby advance the center cutter 102 to the projected position (indicated in the two-dot-and-dash line in FIG. 23) and cause the cutter to bite into the ground face to be excavated. The rotation is then corrected by driving the side cutters 104 and thereby rotating the machine in a direction opposite to that of the rotation, with the center cutter 102 serving as a fixed point.

The rotation can be corrected or remedied automatically by detecting the pressure exerted by the cutting face on the center cutter with an unillustrated pressure sensor and detecting the angle of rotation of the skin plate 1 with a position sensor When the tunnel has been excavated by the machine of the above embodiment, the skin plate 1 may be left at the excavation site, while the main internal components such as the large rotary table 103, center cutter 102 and side cutters 104 may be withdrawn through the tunnel and recovered to above the ground for reuse. This achieves a remarkable reduction in the tunnel excavation cost unlike the case wherein the tunneling machine is left discarded as buried in the site of excavation every time a tunnel has been completed.

To realize this advantage, slide means is provided for the machine for rearwardly moving the large table 103 along with the support wall 112 of the skin plate 1 for supporting the table 103 and the screw conveyor fixed tube 123. Each side cutter 104 is positioned at the corner of the square as seen in FIG. 25, and the small table 107 only is rotated with the air cylinder 183 of the support arm 108 relieved of pressure to thereby move the side cutter 104 inward from the outer peripheral edge of the large table 103. The large table 103 is then withdrawn along with the center cutter 102, the side cutters 104, etc. by the slide means.

Although the pair of side cutters 104 are arranged symmetrically with respect to the center cutter axis X according to the above embodiment, a single side cutter or at least three side cutters may alternatively be provided. However, it is desirable to provide at least two side cutters in a radial and uniform arrangement from the viewpoint of preventing the rotation of the machine.

Figure 28:
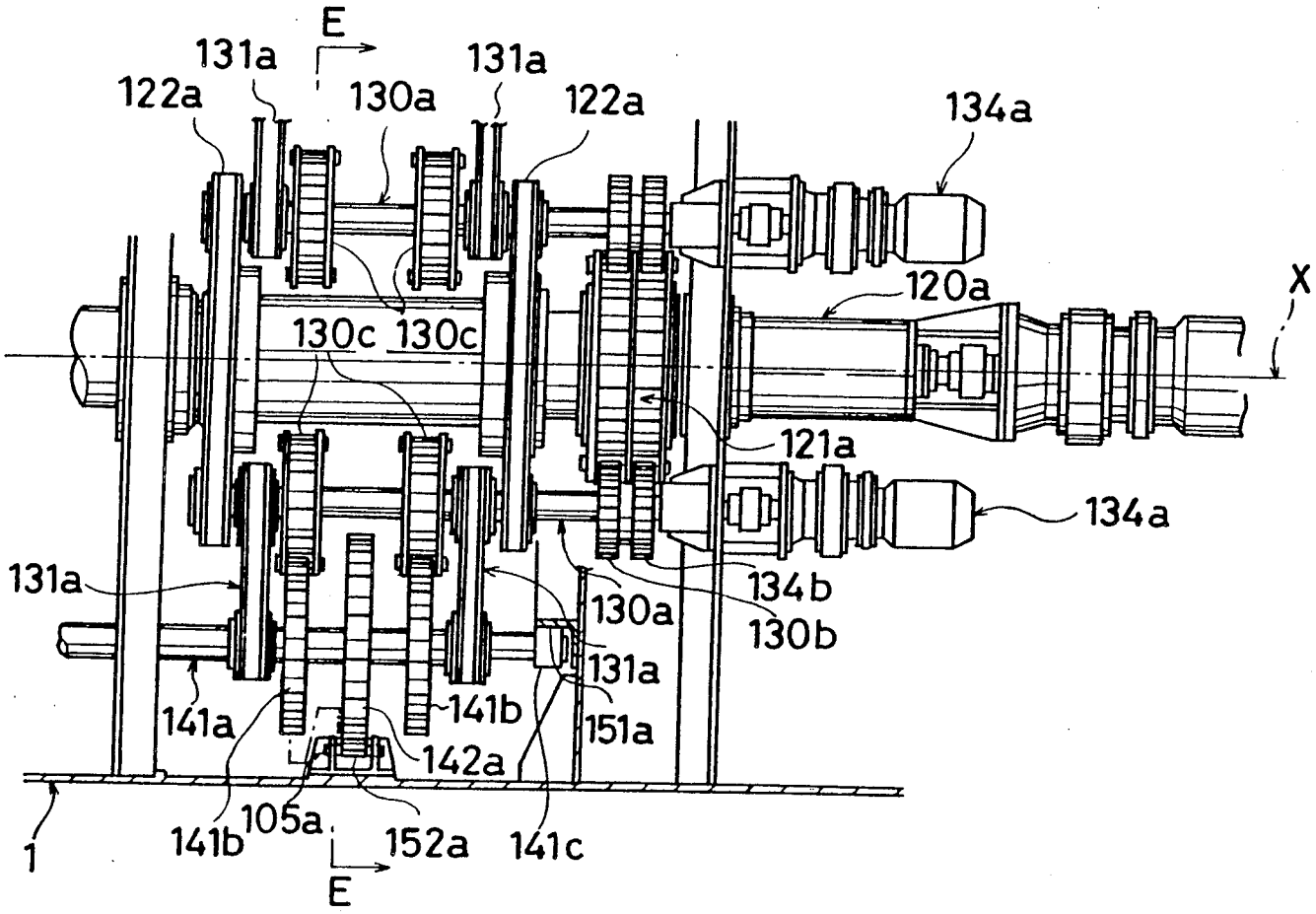
FIG. 28 is a fragmentary side elevation in section showing a shield tunneling machine as a seventh embodiment.
Figure 29:
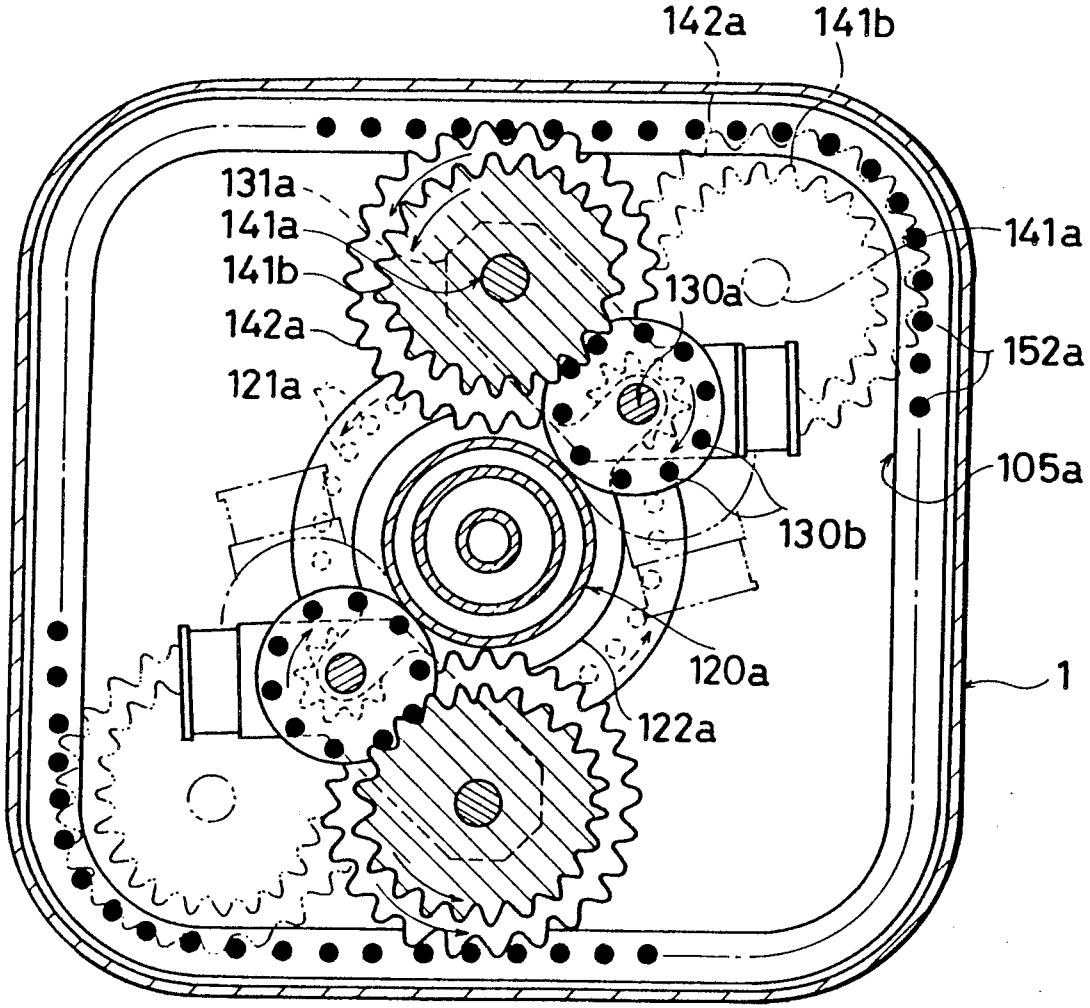
FIG. 29 is a view in section taken along the line E—E in FIG. 28.
Figure 30:
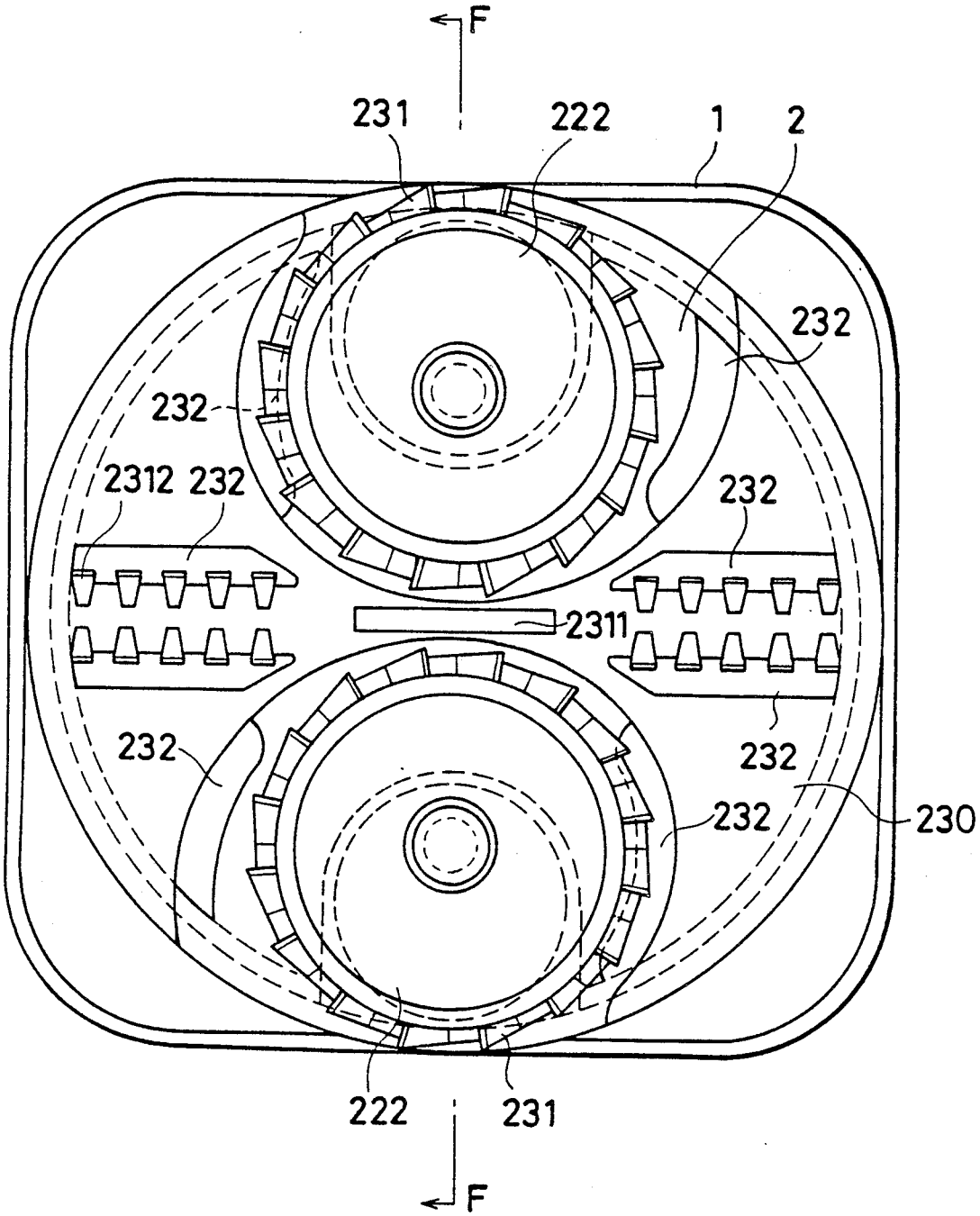
FIG. 30 is a front view showing a shield tunneling machine as an eighth embodiment.
Figure 31:
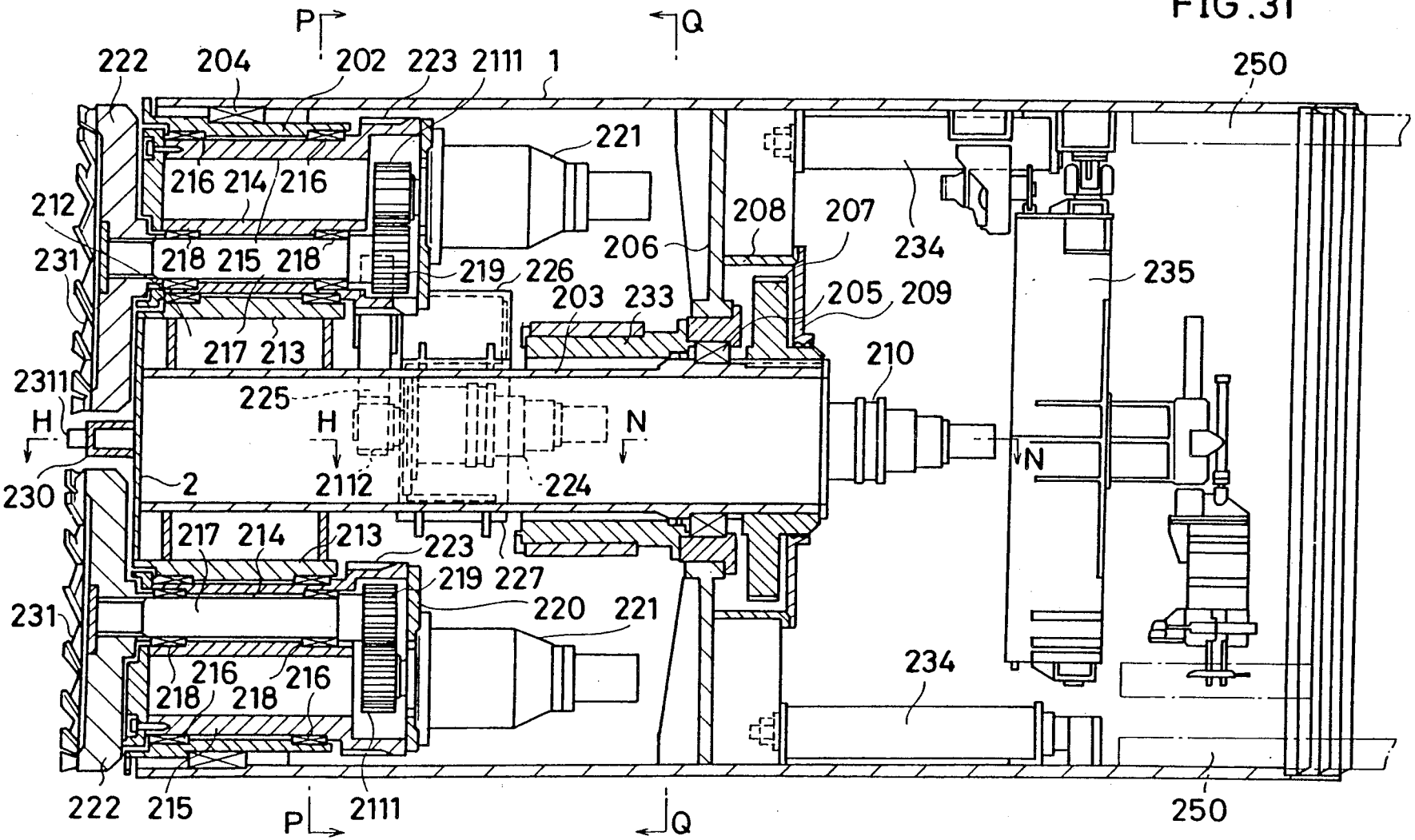
FIG. 31 is a view in section taken along the line F—F in FIG. 30
Figure 33:
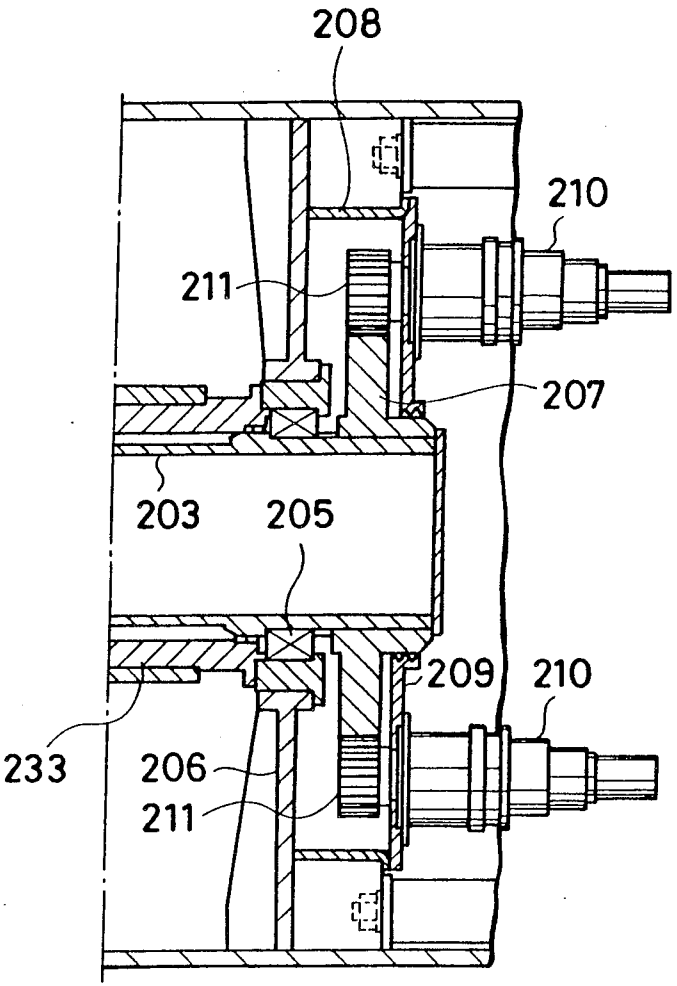
FIG. 33 is a view in section taken along the line N—N in FIG. 31.
Figure 32:
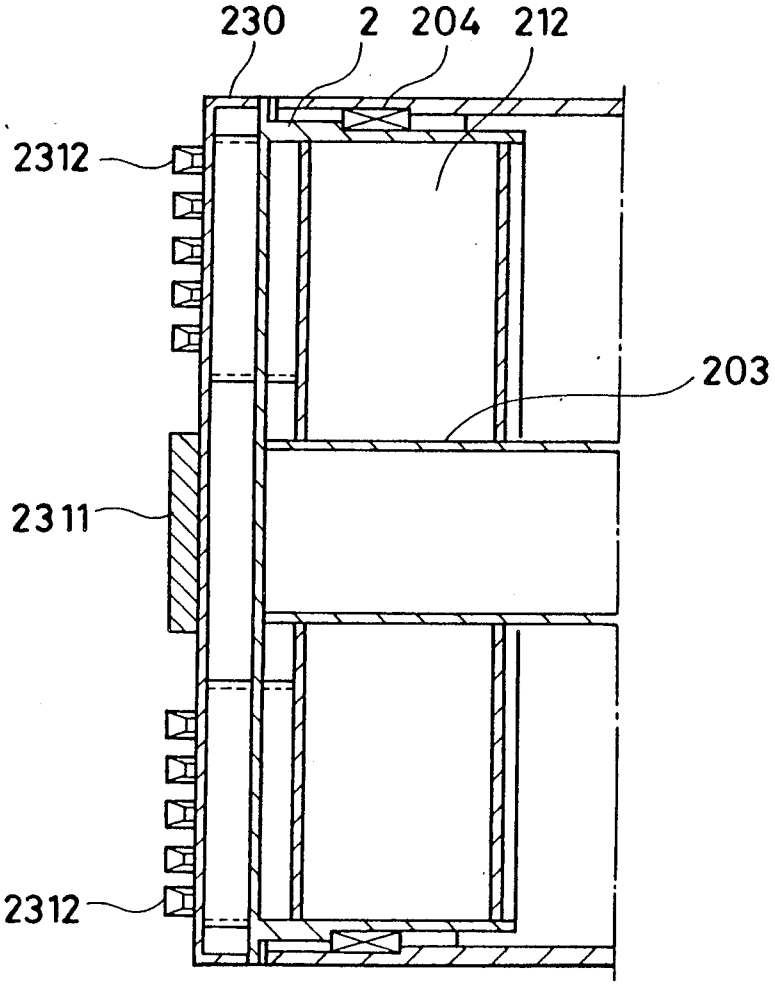
FIG. 32 is a view in section taken along the line H—H in FIG. 31.

A seventh embodiment will be described next with reference to FIGS. 28 and 29.

These drawings show a center cutter shaft 120*a* which has rotatably mounted thereon two pin gears 121*a* integral with each other. A pair of front and rear support plates 122*a* are rotatably mounted on the shaft 120*a*. A pair of transmission shafts 130*a* coupled to one of the pin gears 121*a* are supported by the support plates 122*a* in parallel to the axis X of the center cutter shaft 120*a*. A pair of connecting members 131*a* are rotatably connected each at its one end to the transmission shaft 130*a*. A side cutter rotary shaft 141*a* is rotatably supported by the other ends of the connecting members 131*a*.

The transmission shaft 130*a* has attached thereto a gear 130*b* at one end thereof and a pair of pin gears 130*c* at intermediate portions thereof. The side cutter shaft 141*a* has a pair of transmission gears 141*b* mounted thereon. The transmission shaft 130*a* and the side cutter shaft 141*a* are interconnected by the connecting members 131*a* so that the pin gears 130*c* are in mesh with the respective transmission gears 141*b*.

The side cutter shaft 141*a* further has mounted thereon a guide gear 142*a* positioned between the pair of transmission gears 141*b*. The skin plate 1 has attached thereto a guide frame 105*a* provided with a pin gear 152*a* on its inner periphery which is square or rectangular. The guide gear 142*a* is so sized as to mesh with the pin gear 152*a*.

The skin plate 1 is provided with a guide portion 151*a* having an inner periphery similar to the guide frame 105*a* in shape. A roller 141*c* rotatably mounted on one end of the side cutter shaft 141*a* is in contact with the outer periphery of the guide portion 151*a*.

A side cutter electric motor 134*a* has an output gear 134*a* in mesh with the other pin gear 121*a* on the center cutter shaft 120*a*.

Accordingly, the motor 134*a*, when driven, delivers a torque through the pin gears 121*a* to the transmission shaft 130*a*, which in turn transmits the torque to the side cutter shaft 141*a* via the pair of pin gears 130*c* and the pair of transmission gears 141*b*, whereby the side cutter is drivingly rotated.

Further with the rotation of the shaft 141*a*, the guide gear 142*a* rotates along the pin gear 152*a* on the guide frame 105*a*, and the roller 141*c* moves along by being guided by contact with the guide portion 151*a*, with the result that the side cutter shaft 141*a* revolves about the center cutter axis X along the guide frame 105*a*, following a square locus similar to the guide frame 105*a*. Consequently a tunnel can be excavated with a square cross section.

An eighth embodiment of the invention will be described with reference to FIGS. 30 to 38.

The shield tunneling machine shown in FIGS. 30 to 37 has a skin plate 1 in the form of a cylinder with a rectangular or square cross section. The skin plate 1 houses a cutting wheel 2 in its front end portion. The wheel 2 is attached to the front end (left end in FIG. 31)

of a center shaft 31 extending in the direction of propulsion of the machine and is rotatable therewith.

The outer periphery of the cutting wheel 2 and the rear end of the center shaft 203 are supported on the skin plate 1 by bearings 204 and 205, respectively. The bearing 205 supports radial and thrust loads. The thrust load acting on the cutting wheel 2 during excavation is transmitted to the skin plate 1 through the shaft 203, the bearing 205 and a bearing support frame 206 extending from the skin plate 1. Accordingly, the wheel 2 is supported by the bearings 204 and 205 with respect to both the radial direction and thrust direction and is free to rotate about the axis of the center shaft 203.

A large gear 207 is fixed to the rear end (right end in FIG. 31) of the center shaft 203. The bearing support frame 206 is provided with a gear casing 208 having a lid 209, to which two wheel drive geared motor (rotary body drive means) 210 are attached. A pinion 211 mounted on the output shaft of each motor 210 is in mesh with the large gear 207. Accordingly, the geared motors 210, when operated, drivingly rotate the cutting wheel 2.

The cutting wheel 2 has an interior space, i.e., a chamber 212, and a pair of bosses 213 arranged in the chamber 212 symmetrically with respect to the center shaft 203 and having a cylindrical hole. A rotary wheel (small rotary body) 215 having an eccentric bore 214 is rotatably inserted in each of these bosses 213 with bearings 216 provided therebetween. A planetary cutter drive shaft 217 is rotatably inserted in the eccentric bore 214, with bearings 218 fitted around the shaft. The shaft 217 has a gear 219 at its rear end and is fixedly provided at its front end with a planetary cutter 222 having cutter bits 231 along the entire outer periphery of its front side.

A cover 220 is attached to the rear end of the rotary wheel 215 and has mounted thereon a planetary cutter drive geared motor (planetary cutter drive means) 221. A pinion 2111 mounted on the output shaft of the motor 221 is in mesh with the gear 219. Accordingly, the motor 221, when operated, drivingly rotates a planetary cutter 222. The rear end of the rotary wheel 215 is toothed over the entire circumference thereof to provide a gear 223.

Two rotary wheel drive assemblies 226 are mounted on the center shaft 203 by a bracket 227. Each of these assemblies 226 comprises a rotary wheel drive geared motor 224, a pinion 2112 mounted on the output shaft of the motor 224, an idle gear 225 meshing with the pinion 2112, etc. The idle gear 225 is in mesh with the gear 223 at the rear end of the rotary wheel 215. Accordingly, the motor 224, when operated, drivingly rotates the rotary wheel 215 via the pinion 2112 and idle gear 225.

The cutting wheel 2 is provided on its front side with a face plate 230 which is locally cut out only at the portions where the planetary cutters **22*e* are disposed. The front faces of the planetary cutters 222 are approximately flush with the front face of the cutting wheel 2 (i.e., the front face of the face plate 230). With the face plate 230 thus provided, the planetary cutters 222** only will not greatly project forward. This serves to stabilize the cutting face (the face of ground to be excavated by the tunneling machine), assuring the machine of a smooth excavating operation.

A multiplicity of cutter bits 2311 and 2312 are arranged locally on the face plate 230 for cutting the earth like the planetary cutters 222. The face plate 230 and the cutter pits 2311, 2312 on the surface thereof constitute a center cutter rotatable about the center shaft 203.

The face plate 230 and the cutting wheel 2 are formed with a plurality of windows 232 in communication with the chamber 212 of the wheel 2. The earth removed by the cutter bits 231, 2311, 2312 is led into the chamber 212 through the windows 232, transported rearward by a screw conveyor (not shown) disposed inside the center shaft 203 and then discharged from the machine as by a belt conveyor (not shown).

In addition to the foregoing components, the center shaft 203 is provided therearound with a slip ring 233 for transmitting power (electricity or hydraulic pressure) to the rotary wheel drive geared motors 224 and the planetary cutter drive geared motors 221. The skin plate 1 has in its rear portion a shield jack (propelling means) 234 and an erector 235 for placing segments 250 along the wall of the excavated tunnel.

Figure 38:
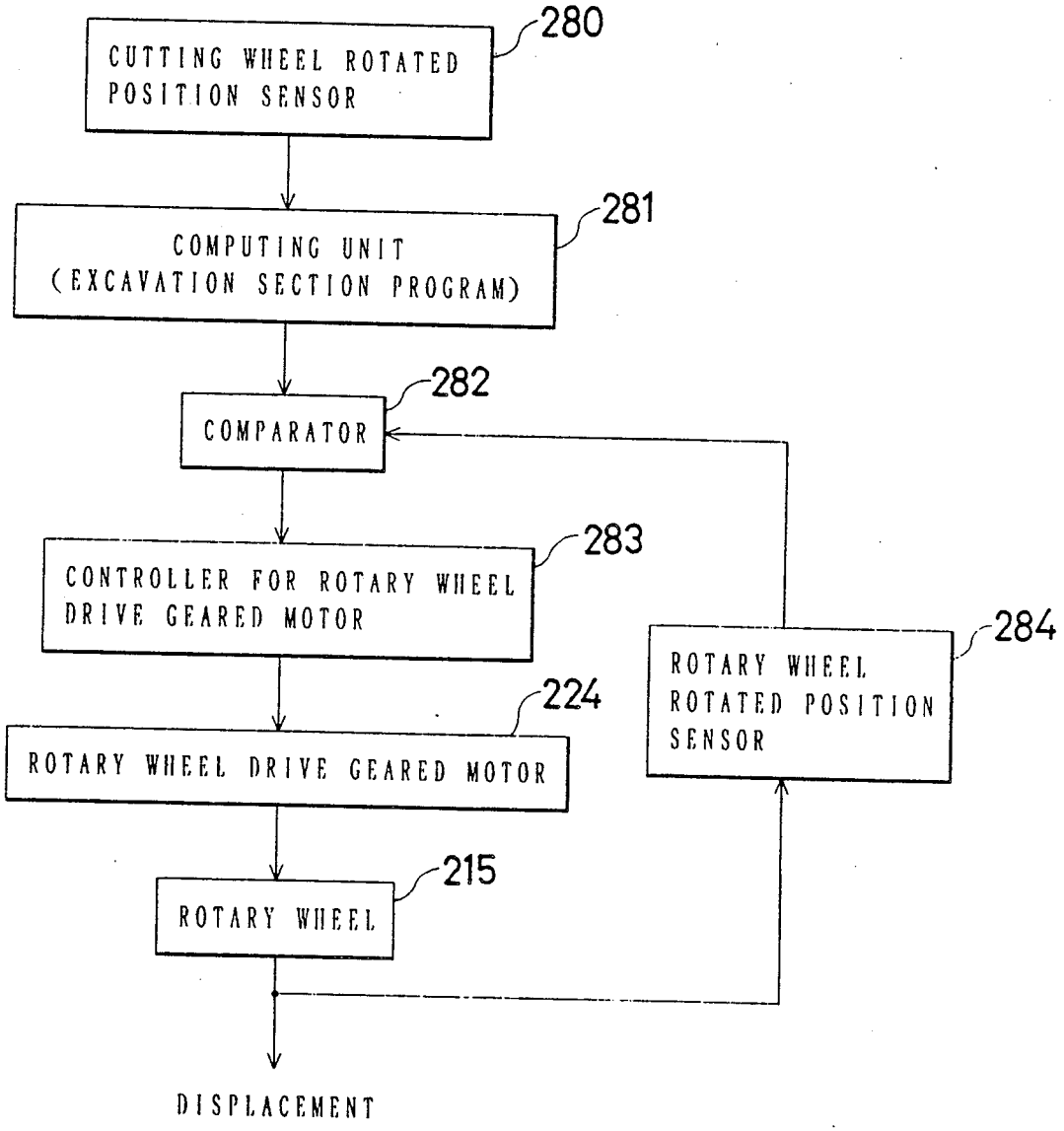
FIG. 38 is a block diagram showing a drive control system included in the machine.

The shield tunneling machine is internally provided with a drive control system as shown in the block diagram of FIG. 38.

The illustrated system includes a cutting wheel (rotary body) rotated position sensor 280 for detecting the rotational displacement (e.g. angle) of the cutting wheel 2 relative to the reference position of the cutting wheel 2. The reference position is, for example, the position in which the center P2 of one of the two rotary wheels 215 is located immediately above the center P1 of the cutting wheel 2 (see FIG. 34).

A rotary wheel rotated position sensor 284 detects the rotational displacement of the rotary wheel 215 relative to the reference position of the wheel 215, The reference position is, for example, the position where the center P3 of the planetary cutter 222 is located in the closest proximity to the center P1 of the wheel 2.

A computing unit 281 has stored therein a program for calculating the rotational displacement of the rotary wheel 215 required relative to the rotational displacement of the cutting wheel 2 and instantaneously calculates the required rotational displacement of the wheel 215 relative to that of the wheel 2 received from the rotated position sensor 280 as will be described in detail later.

A comparator 282 compairs the rotational displacement received from the rotary wheel rotated position sensor 284 with the displacement received from the computing unit 281, feeds to a controller 283 for the rotary wheel drive geared motor 224 a forward or reverse rotation command so as to rotate the wheel 215 in a direction to eliminate the difference between the two displacements, and gives a stop command upon the elimination of the difference. The comparator 282 and the controller 283 constitute comparative control means.

In the case where a hydraulic motor is used as the rotary wheel drive geared motor 224, a servo valve is used as the controller.

The operation of the present shield tunneling machine will be described below.

First, the geared motors 221 are operated to drive the respective planetary cutters 222, and the geared motors 210 are then driven to rotate the cutting wheel 2. When the shield jack 234 is gradually extended, the jack 234 comes into contact with the segment 250 already installed in place, whereupon the jack advances the tunneling machine in its entirety with a propelling reaction force delivered from the segment 250. In this state, the cutting wheel 2 is in rotation, cutting the earth with the cutter bits 2311 and 2312 provided on the face plate 230 and in circular motion, and each planetary cutter 222 also cuts the earth with its cutter bits 231 while rotating about its own axis and revolving.

If the rotary wheel drive geared motor 224 is at rest at this time, the ground portion in front of the wheel 2 only is excavated, and no earth is cut at the corner portions of the skin plate 1. However, when each geared motor 224 is driven, the rotary wheel 215 is driven through the pinion 2112 on the motor output shaft and the idle gear 225, with the result that the cutter bits 231 along the outer periphery of the planetary cutter 222 reach the skin plate corner portion to excavate the portion other than the circular portion.

The operation will be described more specifically with reference to FIG. 34. The center or axis P3 of the planetary cutter drive shaft 217 through the center of the planetary cutter 222 is a distance l1 away from the center P2 of the rotary wheel 215. Accordingly, the rotation of the rotary wheel 215 moves the center P3 of the drive shaft 217 toward and away from the center P1 of the cutting wheel 2, consequently moving the cutter 222 toward and away from the wheel center P1.

Accordingly, when the rotary wheel 215 is suitably driven by operating the geared motor 224, the distance l from the center P1 of the cutting wheel 2 to the center P3 of the planetary cutter 222 can be varied over the range expressed by:

$$l2+l1 \geqq l \geqq l2-l1$$

where l2 is the distance from the center P1 of the cutting wheel 2 to the center P2 of the rotary wheel 215.

To excavate the ground with a square cross section as in the present case, the rotary wheel 215 is to be rotated to a position where the planetary cutter 222 passes the corner portion of the square section, with the distance l increasing to a maximum.

Figure 34:
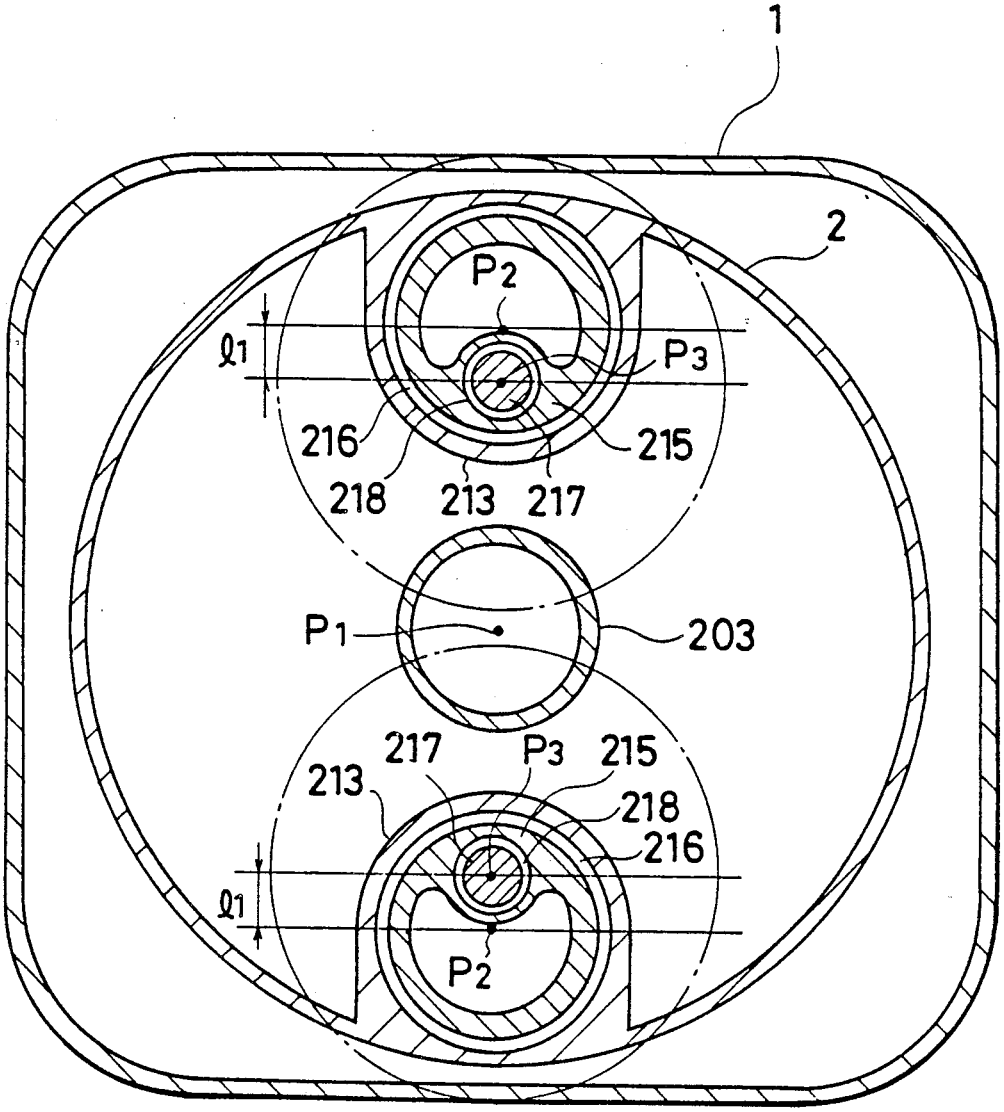
FIG. 34 is a view in section taken along the line P—P in FIG. 31.
Figure 35:
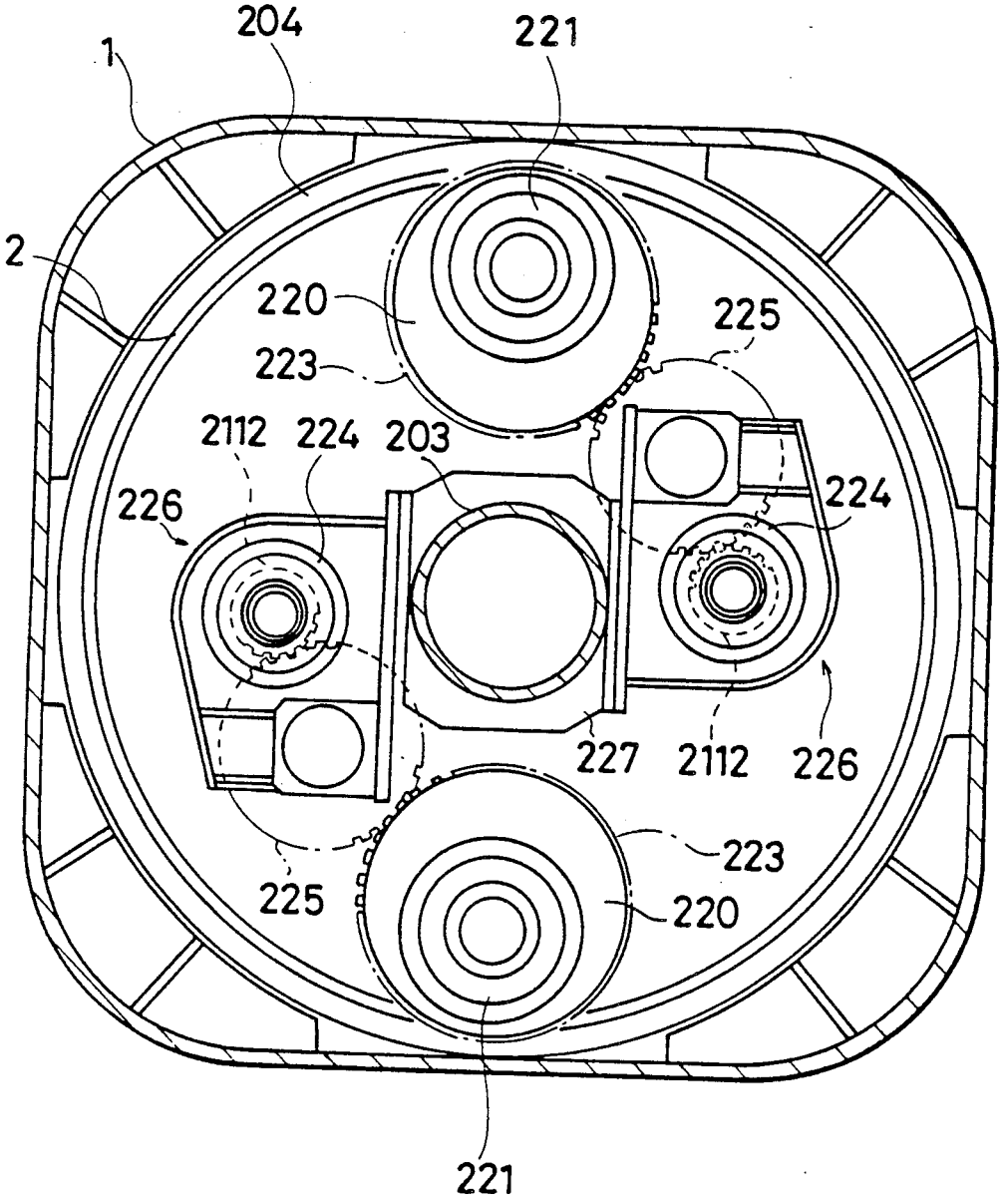
FIG. 35 is a view in section taken along the line Q—Q in FIG. 31.
Figure 36:
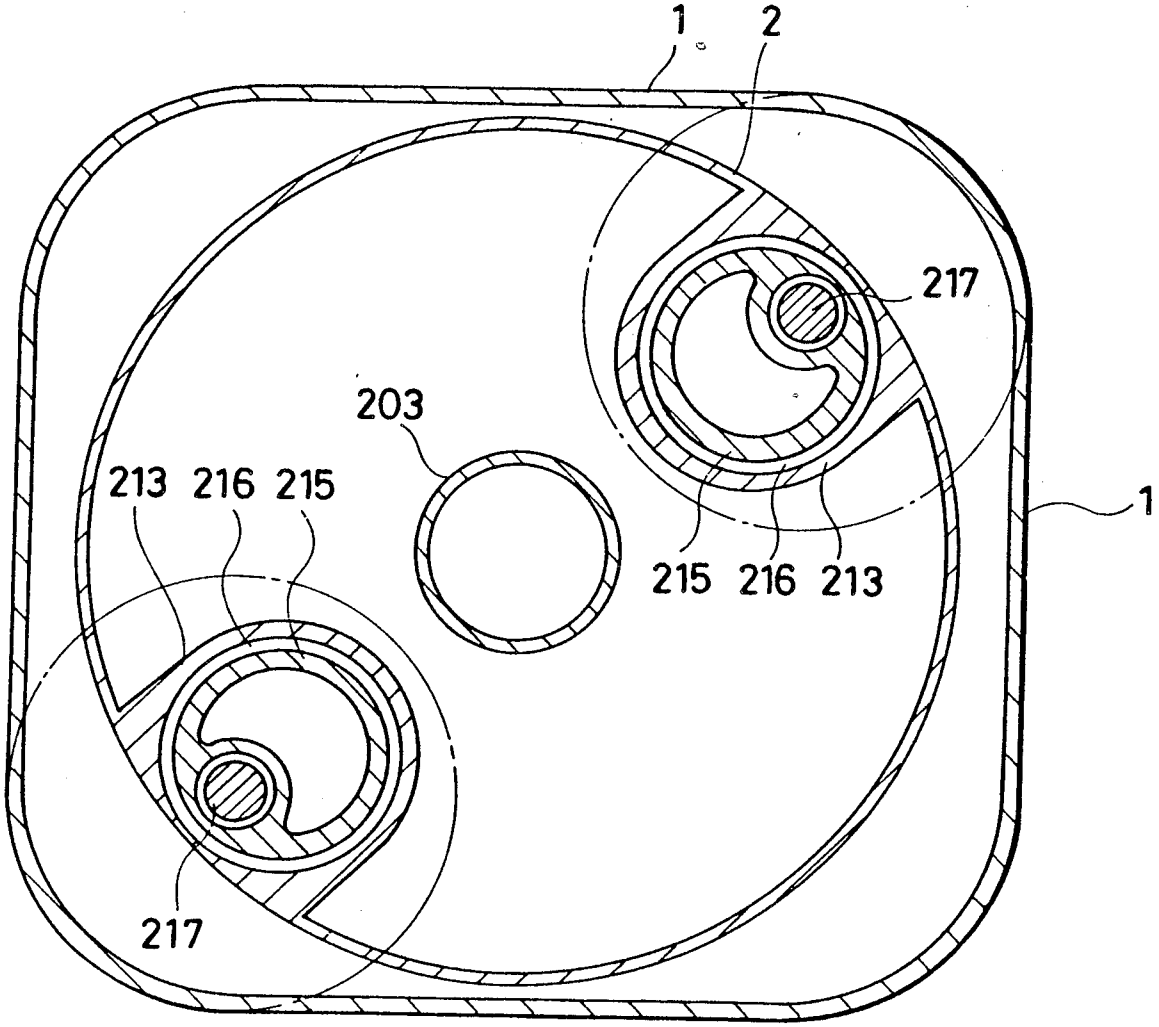
FIG. 36 is a sectional view corresponding to FIG. 34 and showing planetary cutters of the machine as they are positioned on a diagonal of a skin plate.
Figure 37:
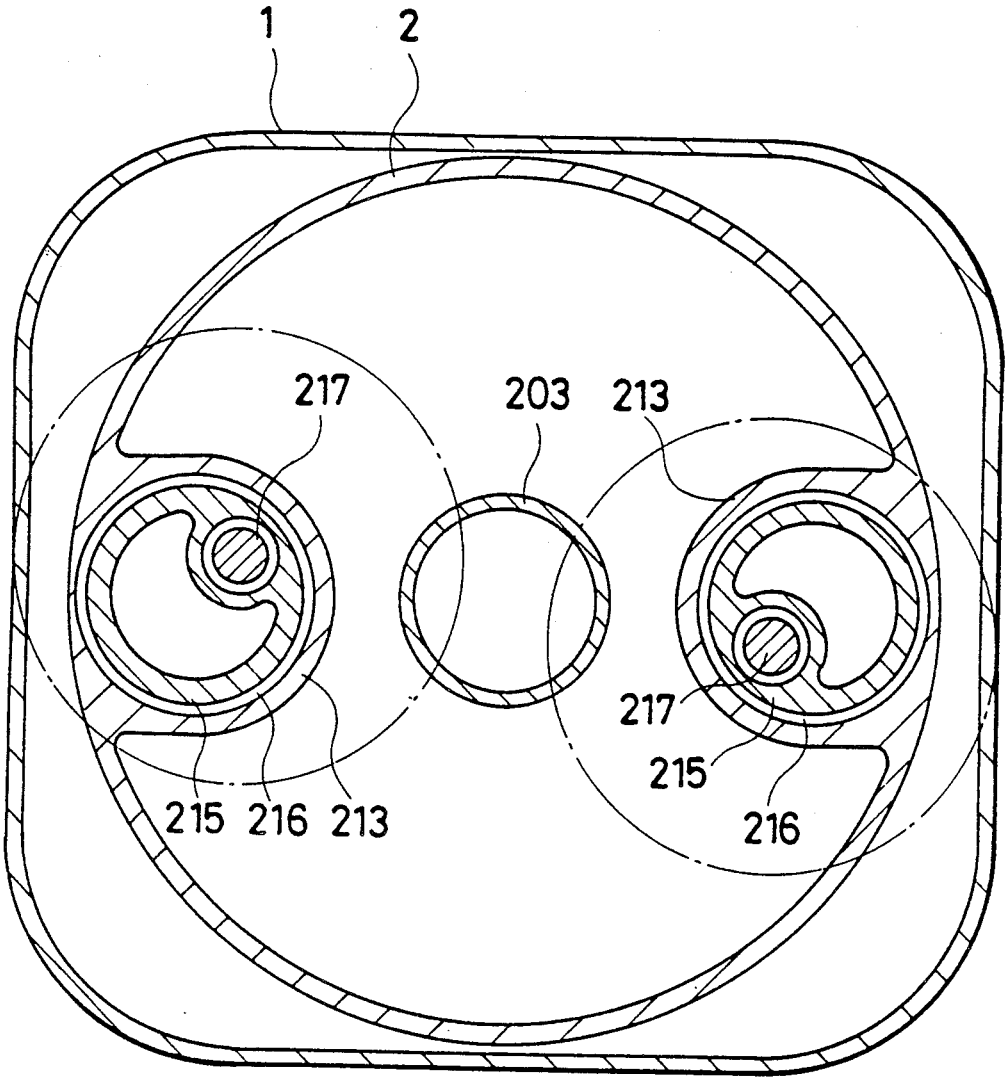
FIG. 37 is a sectional view corresponding to FIG. 34 and showing the planetary cutters as positioned in the middle of opposed sides of the skin plate.

For example, to realize the state wherein the pair of rotary wheels 215 are positioned on the diagonal as seen in FIG. 36, each rotary body 215 as positioned in FIG. 34 is rotated through 180°, whereby the region of excavation can be enlarged to the corner portions of the square. Conversely, when the cutting wheel 2 is in the state shown in FIG. 37, as rotated through 90° from the position in FIG. 34, the rotary wheels 215 are so rotated that the distance between the planetary cutters 222, and accordingly the distance l, will decrease. Thus, the ground can be excavated with a specified distance automatically by varying the rotated position of the rotary wheels 215 in accordance with the angle of rotation of the cutting wheel 2.

With the drive control system shown in FIG. 38, therefore, the rotational displacement of the rotary wheel 215 required to obtain the desired cross section relative to the rotated position of the wheel 2 is calculated and then compared with the actual rotational displacement detected, by the computing unit 281, and the rotation of the rotary wheel 215 is controlled based on the result of comparison, whereby the planetary cutter 222 can be revolved about the center P1 along a locus in conformity with the desired cross section to be excavated. As will be apparent from FIGS. 34, 36 and 37, the rotary wheel 215 is rotated forward and reversely over the range of 180°.

Thus, the present shield tunneling machine for practicing the method of the invention automatically readily excavates the ground in various cross sectional configurations such as those shown in FIGS. 15 to 17 when the program stored in the computing unit 281 is suitably changed. Furthermore, the machine is adapted to overcut the ground advantageously in the manner already described.

Figure 40:
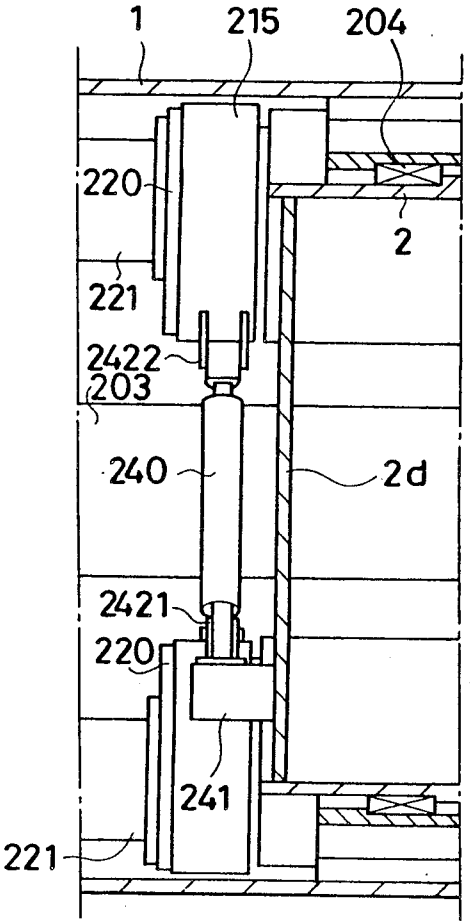
FIG. 40 is a view in section taken along the line R—R in FIG. 39.
Figure 39:
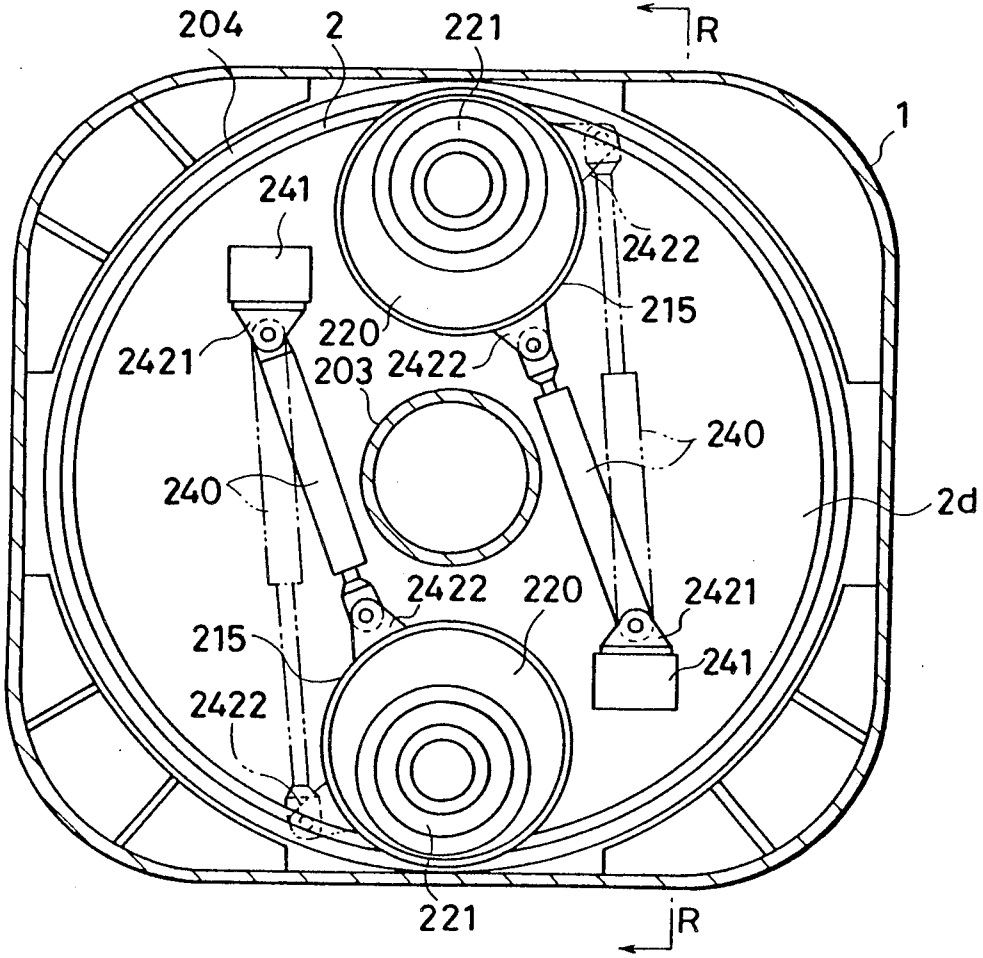
FIG. 39 is a front view in section showing a shield tunneling machine as a ninth embodiment.

A ninth embodiment will be described with reference to FIGS. 39 and 40. In this embodiment, the rotary wheel drive assemblies 226 in the above embodiment are replaced by hydraulic cylinders 240 for drivingly rotating the rotary wheels 215.

More specifically, an intermediate plate 2*d* of the cutting wheel 2 is provided with a pair of cylinder support posts 241. Brackets 2421 and 2422 are attached to each post 241 and an outer peripheral portion of each rotary wheel 215, respectively. The hydraulic cylinder 240 is pivoted at its opposite ends to the brackets 2421, 2422.

With this arrangement, the rotary wheel 215 can be driven forward and reversely by the extension and contraction of the hydraulic cylinder 240. The present embodiment has the advantage of being very simple in construction although the range of rotation of the rotary wheel 215 is small. The drive control system of this embodiment includes a hydraulic cylinder controller (servo valve) in place of the motor controller 283 shown in FIG. 38.

According to the invention, the number and arrangement of planetary cutters are not limited specifically but can be determined suitably in accordance with conditions such as the type of earth to be handled.

Although the displacement of the rotary wheel 215 or like pivotal member is detected and computed at all times according to the embodiment described, the speed of rotation of members such as cutting wheel 2 and the pivotal member may be predetermined for a particular cross section of excavation, and an angular correction may be made periodically in the course of excavation for a controlled operation.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What we claim is:

1. A machine for shield tunneling with an optional cross section characterized in that the machine comprises:

a machine body, a center cutter supported by the machine body so as to be rotatable about an axis extending in the direction of propulsion of the body, a rotary body supported so as to be rotatable about the same axis as the center cutter, a planetary cutter supported by the rotary body so as to be movable radially of the rotary body, and operating means for moving the planetary cutter radially of the rotary body to permit the planetary cutter to revolve along a locus during the rotation of the rotary body so that the planetary cutter excavates the region between the profile of excavation by the center cutter and the desired profile of excavation, wherein the operating means comprises:

a pivotal member pivotally movably supported by the rotary body at a position away from the axis of rotation thereof and supporting the planetary cutter thereon at a position away from the axis of its pivotal movement, a guide member having a guide form in conformity with the desired profile of excavation, and regulating means for pressing the movable end of the pivotal member against the guide member for regulating the locus of revolution of the planetary cutter, wherein the pivotal member comprises:

a torsion bar, a lever secured to the front portion of the torsion bar and rotatably supporting the planetary cutter at its movable end, and a control lever secured to the rear portion of the torsion bar and having a movable end pressed against the guide member.

2. A machine as defined in claim 1 wherein the operating means comprises:

a pivotal member pivotally movably supported by the rotary body at a position away from the axis of rotation thereof and supporting the planetary cutter thereon at a position away from the axis of its pivotal movement, means for driving the pivotal member, and a drive control system for controlling the drive of the pivotal member so that the planetary cutter revolves along a locus to excavate the region between the profile of excavation by the center cutter and the desired profile of excavation.

3. A machine as defined in claim 1 further comprising:

a small rotary member rotatably mounted on the rotary body, the planetary cutter being rotatably attached to the small rotary member at a position away from the axis of rotation thereof.

4. A machine as defined in claim 1 which comprises a plurality of planetary cutters and a plurality of planetary cutter drive means provided for the respective planetary cutters and mounted on the rotary body, the planetary cutters being drivable individually by the respective planetary cutter drive means.

5. A machine for shield tunneling with an optional cross section characterized in that the machine comprises:

a machine body, a center cutter supported by the machine body so as to be rotatable about an axis extending in the direction of propulsion of the body, a rotary body supported so as to be rotatable about the same axis as the center cutter, a planetary cutter supported by the rotary body so as to be movable radially of the rotary body, and operating means for moving the planetary cutter radially of the rotary body to permit the planetary cutter to revolve along a locus during the rotation of the rotary body so that the planetary cutter excavates the region between the profile of excavation by the center cutter and the desired profile of excavation, wherein the operating means comprises:

a pivotal member pivotally movably supported by the rotary body at a position away from the axis of rotation thereof and supporting the planetary cutter thereon at a position away from the axis of its pivotal movement, a guide member having a guide form in conformity with the desired profile of excavation, and regulating means for pressing the movable end of the pivotal member against the guide member for regulating the locus of revolution of the planetary cutter, wherein the guide member is a guide rail having an inner periphery shaped in conformity with the desired profile of excavation, and a roller in contact with the inner periphery of the guide rail is mounted on the movable end of the pivotal member.

6. A machine for shield tunneling with an optional cross section characterized in that the machine comprises:

a machine body, a center cutter supported by the machine body so as to be rotatable about an axis extending in the direction of propulsion of the body, a rotary body supported so as to be rotatable about the same axis as the center cutter, a planetary cutter supported by the rotary body so as to be movable radially of the rotary body, and operating means for moving the planetary cutter radially of the rotary body to permit the planetary cutter to revolve along a locus during the rotation of the rotary body so that the planetary cutter excavates the region between the profile of excavation by the center cutter and the desired profile of excavation, wherein the operating means comprises:

a pivotal member pivotally movably supported by the rotary body at a position away from the axis of rotation thereof and supporting the planetary cutter thereon at a position away from the axis of its pivotal movement, a guide member having a guide form in conformity with the desired profile of excavation, and regulating means for pressing the movable end of the pivotal member against the guide member for regulating the locus of revolution of the planetary cutter, wherein the guide member is an internal gear toothed in conformity with the desired profile of excavation, and a pinion meshing with the internal gear is mounted on the movable end of the pivotal member.

7. A machine for shield tunneling with an optional cross section characterized in that the machine comprises:

a machine body, a center cutter supported by the machine body so as to be rotatable about an axis extending in the direction of propulsion of the body, a rotary body supported so as to be rotatable about the same axis as the center cutter, a planetary cutter supported by the rotary body so as to be movable radially of the rotary body, and operating means for moving the planetary cutter radially of the rotary body to permit the planetary cutter to revolve along a locus during the rotation of the rotary body so that the planetary cutter excavates the region between the profile of excavation by the center cutter and the desired profile of excavation, wherein the operating means comprises:

a pivotal member pivotally movably supported by the rotary body at a position away from the axis of rotation thereof and supporting the planetary cutter thereon at a position away from the axis of its pivotal movement, a guide member having a guide form in conformity with the desired profile of excavation, and regulating means for pressing the movable end of the pivotal member against the guide member for regulating the locus of revolution of the planetary cutter, wherein the pivotal member comprises:

a torsion bar, a lever secured to the front portion of the torsion bar and rotatably supporting the planetary cutter at its movable end, and a control lever secured to the rear portion of the torsion bar and having the pivotal member driving means connected to its movable end.

8. A machine for shield tunneling with an optional cross section characterized in that the machine comprises:

a machine body, a center cutter supported by the machine body so as to be rotatable about an axis extending in the direction of propulsion of the body, a rotary body supported so as to be rotatable about the same axis as the center cutter, a planetary cutter supported by the rotary body so as to be movable radially of the rotary body, and operating means for moving the planetary cutter radially of the rotary body to permit the planetary cutter to revolve along a locus during the rotation of the rotary body so that the planetary cutter excavates the region between the profile of excavation by the center cutter and the desired profile of excavation, wherein the operating means comprises:

a pivotal member pivotally movably supported by the rotary body at a position away from the axis of rotation thereof and supporting the planetary cutter thereon at a position away from the axis of its pivotal movement, a guide member having a guide form in conformity with the desired profile of excavation, and regulating means for pressing the movable end of the pivotal member against the guide member for regulating the locus of revolution of the planetary cutter, wherein the drive control system comprises:

a sensor for detecting the actual rotated position of the rotary body, a sensor for detecting the moved position of the pivotal member relative to the rotary body, a computing unit for calculating the amount of pivotal movement required of the pivotal member relative to the rotational displacement of the rotary body, and comparative control means for comparing the displacement received from the pivotal member moved position sensor with the calculated displacement received from the computing unit and controlling the drive of the pivotal member so as to eliminate the difference between the displacements.

9. A machine as defined in claim 8 wherein the computing unit is adapted to calculate the amount of pivotal movement required of the pivotal member selectively for a basic excavation cross section and a plurality of cross sections each including the basic excavation cross section plus an additional cross section on each of the upper, lower, left and right sides of the basic cross section.

10. A machine for shield tunneling with an optional cross section characterized in that the machine comprises:

a machine body, a center cutter supported by the machine body so as to be rotatable about an axis extending in the direction of propulsion of the body, a rotary body supported so as to be rotatable about the same axis as the center cutter, a planetary cutter supported by the rotary body so as to be movable radially of the rotary body, and operating means for moving the planetary cutter radially of the rotary body to permit the planetary cutter to revolve along a locus during the rotation of the rotary body so that the planetary cutter excavates the region between the profile of excavation by the center cutter and the desired profile of excavation, further comprising:

drive means for driving the rotary body, and a drive conversion mechanism for converting the rotation of the rotary body to the rotation of the planetary cutter, both the center cutter and the planetary cutter being drivingly rotatably by the drive means.

11. A machine as defined in claim 10 wherein the drive conversion mechanism comprises:

a planetary cutter drive gear fixed to the machine body, and a planetary cutter drive pinion connected to the rotary shaft of the planetary cutter and meshing with the drive gear, the planetary cutter drive pinion and the planetary cutter being rotatable by the rotation of the rotary body.

12. A machine as defined in claim 11 further comprising:

an agitator member rotatably supported by the rotary body and having agitating blades on a portion thereof positioned inside a chamber of the machine body, and an agitator member drive pinion connected to the agitator member and meshing with the planetary cutter drive gear, the agitator member drive pinion and the agitator member being rotatable by the rotation of the rotary body.

13. A machine for shield tunneling with an optional cross section characterized in that the machine comprises:

a machine body, a center cutter supported by the machine body so as to be rotatable about an axis extending in the direction of propulsion of the body, a rotary body supported so as to be rotatable about the same axis as the center cutter, a planetary cutter supported by the rotary body so as to be movable radially of the rotary body, and operating means for moving the planetary cutter radially of the rotary body to permit the planetary cutter to revolve along a locus during the rotation of the rotary body so that the planetary cutter excavates the region between the profile of excavation by the center cutter and the desired profile of excavation, wherein said planetary cutter has a rotary shaft, further comprising:

means for driving the rotary body, planetary cutter drive means, and a drive transmission for transmitting the torque of the planetary cutter drive means to the rotary shaft of the planetary cutter.

14. A machine as defined in claim 13 wherein the drive transmission comprises:

a planetary cutter drive gear drivingly rotatable by the planetary cutter drive means, and a planetary cutter drive pinion connected to the rotary shaft of the planetary cutter and meshing with the drive gear, the planetary cutter drive pinion and the planetary cutter being drivingly rotatable by the rotation of the planetary cutter drive gear.

15. A machine as defined in claim 14 wherein the planetary cutter drive gear is a double gear having a first gear and a second gear integral therewith, the first gear being in mesh with the planetary cutter drive pinion, the second gear being in mesh with a driving pinion connected to the planetary cutter drive means.

16. A machine as defined in claim 14 further comprising:

an agitator member rotatably supported by the rotary body and having agitating blades on a portion thereof positioned inside a chamber of the machine body, and an agitator member drive pinion connected to the agitator member and meshing with the planetary cutter drive gear, the agitator member drive pinion and the agitator member being rotatable by the rotation of the planetary cutter drive gear.

17. A machine as defined in claim 13 wherein the planetary cutter drive gear has a front half portion and a rear half portion and the planetary cutter drive pinion is in mesh with the front half portion of the planetary cutter drive gear, and a driving pinion connected to the planetary cutter drive means is in mesh with the rear half portion of the drive gear.

* * * * *